US008289246B2

(12) United States Patent
Ohhashi et al.

(10) Patent No.: US 8,289,246 B2
(45) Date of Patent: Oct. 16, 2012

(54) ELECTRIC CURRENT DRIVING TYPE DISPLAY DEVICE AND PIXEL CIRCUIT

(75) Inventors: Seiji Ohhashi, Tenri (JP); Takahiro Senda, Nara (JP); Toshihiro Ohba, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 1016 days.

(21) Appl. No.: 12/294,834

(22) PCT Filed: Dec. 18, 2006

(86) PCT No.: PCT/JP2006/325202
§ 371 (c)(1),
(2), (4) Date: Sep. 26, 2008

(87) PCT Pub. No.: WO2007/144976
PCT Pub. Date: Dec. 21, 2007

(65) Prior Publication Data

US 2010/0225623 A1 Sep. 9, 2010

(30) Foreign Application Priority Data

Jun. 15, 2006 (JP) ..... 2006-166481

(51) Int. Cl.
*G09G 3/32* (2006.01)

(52) U.S. Cl. ..... 345/82; 345/83

(58) Field of Classification Search ..... 345/55, 345/76, 77, 80, 82, 83, 84, 87, 88, 92; 315/160, 315/167, 169.1, 169.3
See application file for complete search history.

(56) References Cited

U.S. PATENT DOCUMENTS

| | | | | |
|---|---|---|---|---|
| 6,380,689 | B1 * | 4/2002 | Okuda | 315/169.3 |
| 2004/0095168 | A1 | 5/2004 | Miyazawa | |
| 2004/0257353 | A1 | 12/2004 | Imamura et al. | |
| 2005/0264498 | A1 | 12/2005 | Asano | |
| 2006/0139264 | A1 * | 6/2006 | Choi et al. | 345/76 |
| 2009/0231308 | A1 * | 9/2009 | Numao | 345/204 |

FOREIGN PATENT DOCUMENTS

| | | | |
|---|---|---|---|
| JP | 2004-145300 | A | 5/2004 |
| JP | 2005-165178 | A | 6/2005 |
| JP | 2005-338591 | A | 12/2005 |
| JP | 2006-84682 | A | 3/2006 |
| JP | 2006-91923 | A | 4/2006 |
| WO | WO-98/48403 | A1 | 10/1998 |

OTHER PUBLICATIONS

Jung et al., "A 14.1 inch Full Color AMOLED Display with Top Emission Structure and a- Si TFT Backplane" SID' 05 Digest, 2005, pp. 1538-1541.

* cited by examiner

*Primary Examiner* — My-Chau T Tran
(74) *Attorney, Agent, or Firm* — Birch, Stewart, Kolasch & Birch, LLP

(57) ABSTRACT

In a pixel circuit 100, a switching TFT 114, a driving TFT 110, and an organic EL element 130 are provided between a power supply wiring line Vp and a common cathode Vcom and a capacitor 121 and a switching TFT 111 are provided between a gate terminal of the driving TFT 110 and a data line Sj. A switching TFT 112 is provided between a connection point A between the capacitor 121 and the switching TFT 111 and a power supply wiring line Vr, a switching TFT 113 is provided between the gate and drain terminals of the driving TFT 110, and a capacitor 122 is provided between the gate terminal of the driving TFT 110 and the power supply wiring line Vr. Thus, a display device is provided that can freely set a period during which variations in the threshold voltage of a drive element are compensated for, and performs high-quality display by holding a control terminal potential of the drive element during light emission from an electro-optical element.

10 Claims, 13 Drawing Sheets

ELECTRIC CURRENT DRIVING TYPE DISPLAY DEVICE AND PIXEL CIRCUIT

TECHNICAL FIELD

The present invention relates to a display device and more particularly to an electric current driving type display device such as an organic EL display or FED.

BACKGROUND ART

In recent years, there have been demands for thin, lightweight, fast response display devices, and accordingly, research and development for organic EL (Electro Luminescence) displays and FEDs (Field Emission Displays) have been actively conducted.

An organic EL element included in an organic EL display emits light with higher luminance as the voltage to be applied thereto is higher and the amount of current flowing therethrough is larger. However, the relationship between luminance and voltage of the organic EL element easily varies due to an influence such as drive time or ambient temperature. Hence, when a voltage control type drive scheme is adopted in an organic EL display, it is very difficult to suppress variations in the luminance of the organic EL element. In contrast to this, the luminance of the organic EL element is substantially proportional to current and this proportional relationship is less susceptible to external factors such as ambient temperature. Therefore, it is desirable to adopt an electric current control type drive scheme in the organic EL display.

Meanwhile, a pixel circuit and a drive circuit of a display device are composed using TFTs (Thin Film Transistors) made of amorphous silicon, low-temperature polycrystal silicon, CG (Continuous Grain) silicon, or the like. However, variations easily occur in TFT characteristics (e.g., threshold voltage and mobility). In view of this, a circuit that compensates for variations in TFT characteristics is provided in a pixel circuit of an organic EL display and by the action of this circuit, variations in the luminance of the organic EL element are suppressed.

Schemes to compensate for variations in TFT characteristics in an electric current driving type drive scheme are broadly divided into an electric current program scheme in which the amount of current flowing through a driving TFT is controlled by a current signal; and a voltage program scheme in which such an amount of current is controlled by a voltage signal. Use of the electric current program scheme enables to compensate for variations in threshold voltage and mobility and use of the voltage program scheme enables to compensate for only variations in threshold voltage.

However, the electric current program scheme has the following problems: first, since a very small amount of current is handled, it is difficult to design a pixel circuit and a drive circuit; and second, since it is susceptible to parasitic capacitance while a current signal is set, it is difficult to achieve a large area circuit. On the other hand, in the voltage program scheme, an influence of parasitic capacitance, etc., is little and a circuit design is also relatively simple. In addition, the influence exerted on the amount of current by variations in mobility is smaller than the influence exerted on the amount of current by variations in threshold voltage and the variations in mobility can be suppressed to a certain extent in a TFT fabrication process. Accordingly, even a display device adopting the voltage program scheme can obtain satisfactory display quality.

For an organic EL display adopting the electric current driving type drive scheme, a pixel circuit shown below has been conventionally known. FIG. 15 is a circuit diagram of a pixel circuit described in Patent Document 1. A pixel circuit 910 shown in FIG. 15 includes a driving TFT 911, switching TFTs 912 to 914, capacitors 915 and 916, and an organic EL element 917. All of the TFTs included in the pixel circuit 910 are of a p-channel type.

In the pixel circuit 910, the driving TFT 911, the switching TFT 914, and the organic EL element 917 are provided in series between a power supply wiring line Vp (potential is VDD) and a ground. The capacitor 915 and the switching TFT 912 are provided in series between a gate terminal of the driving TFT 911 and a data line Sj. The switching TFT 913 is provided between the gate and drain terminals of the driving TFT 911 and the capacitor 916 is provided between the gate terminal of the driving TFT 911 and the power supply wiring line Vp. A gate terminal of the switching TFT 912 is connected to a scanning line Gi, a gate terminal of the switching TFT 913 is connected to an auto-zero line AZi, and a gate terminal of the switching TFT 914 is connected to an illumination line ILi.

FIG. 16 is a timing chart of the pixel circuit 910. Before time t0, the potentials of the scanning line Gi and the auto-zero line AZi are controlled to a high level, the potential of the illumination line ILi is controlled to a low level, and the potential of the data line Sj is controlled to a reference potential Vstd. When at time t0 the potential of the scanning line Gi is changed to a low level, the switching TFT 912 is changed to a conduction state. Then, when at time t1 the potential of the auto-zero line AZi is changed to a low level, the switching TFT 913 is changed to a conduction state. Thus, the gate and drain terminals of the driving TFT 911 are equal in potential.

Then, when at time t2 the potential of the illumination line ILi is changed to a high level, the switching TFT 914 is changed to a non-conduction state. At this time, a current flows into the gate terminal of the driving TFT 911 from the power supply wiring line Vp through the driving TFT 911 and the switching TFT 913, and the gate terminal potential of the driving TFT 911 rises while the driving TFT 911 is in a conduction state. The driving TFT 911 is changed to a non-conduction state when the gate-source voltage becomes a threshold voltage Vth (negative value) (i.e., the gate terminal potential becomes (VDD+Vth)). Therefore, the gate terminal potential of the driving TFT 911 rises to (VDD+Vth).

Then, when at time t3 the potential of the auto-zero line AZi is changed to a high level, the switching TFT 913 is changed to a non-conduction state. At this time, a potential difference (VDD+Vth−Vstd) between the gate terminal of the driving TFT 911 and the data line Sj is held in the capacitor 915.

Then, when at time t4 the potential of the data line Sj is changed from the reference potential Vstd to a data potential Vdata, the gate terminal potential of the driving TFT 911 is changed by the same amount (Vdata−Vstd) and thus becomes (VDD+Vth+Vdata−Vstd). Then, when at time t5 the potential of the scanning line Gi is changed to a high level, the switching TFT 912 is changed to a non-conduction state. At this time, a gate-source voltage (Vth+Vdata−Vstd) of the driving TFT 911 is held in the capacitor 916.

Then, when at time t6 the potential of the illumination line ILi is changed to a low level, the switching TFT 914 is changed to a conduction state. Thus, a current flows through the organic EL element 917 from the power supply wiring line Vp through the driving TFT 911 and the switching TFT 914. Although the amount of current flowing through the driving TFT 911 increases or decreases depending on the gate terminal potential (VDD+Vth+Vdata−Vstd), even when the threshold voltage Vth is different, if the potential difference (Vdata−Vstd) is the same, then the amount of current is the same. Therefore, regardless of the value of the threshold voltage Vth, a current of an amount according to the potential Vdata flows through the organic EL element 917 and thus the organic EL element 917 emits light with a luminance according to the data potential Vdata.

As such, according to the pixel circuit 910, variations in the threshold voltage of the driving TFT 911 can be compensated for and the organic EL element 917 is allowed to emit light with a desired luminance.

FIG. 17 is a circuit diagram of a pixel circuit described in Patent Document 2. A pixel circuit 920 shown in FIG. 17 includes a driving TFT 921, switching TFTs 922 to 925, capacitors 926 and 927, and an organic EL element 928. All of the TFTs included in the pixel circuit 920 are of an n-channel type.

In the pixel circuit 920, the driving TFT 921, the switching TFT 925, and the organic EL element 928 are provided in series between a power supply wiring line Vp (potential is VDD) and the ground. The capacitor 926 and the switching TFT 922 are provided in series between a gate terminal of the driving TFT 921 and a data line Sj. Hereinafter, a connection point between the capacitor 926 and the switching TFT 922 is referred to as A. The switching TFT 923 is provided between the gate terminal of the driving TFT 921 and a power supply wiring line Vr (potential is a reference potential Vpc), the switching TFT 924 is provided between the connection point A and a source terminal of the driving TFT 921 and the capacitor 927 is provided between the connection point A and the power supply wiring line Vp. A gate terminal of the switching TFT 922 is connected to a scanning line Gi, gate terminals of the respective switching TFTs 923 and 924 are connected to an auto-zero line AZi, and a gate terminal of the switching TFT 925 is connected to a driving line DRi.

FIG. 18 is a timing chart of the pixel circuit 920. Before time t0, the potentials of the scanning line Gi and the auto-zero line AZi are controlled to a low level and the potential of the driving line DRi is controlled to a high level. When at time t0 the potential of the auto-zero line AZi is changed to a high level, the switching TFTs 923 and 924 are changed to a conduction state. Thus, the source terminal of the driving TFT 921 and the connection point A are equal in potential, the gate terminal potential of the driving TFT 921 is changed to the reference potential Vpc. The reference potential Vpc is set to a level at which the driving TFT 921 is in a conduction state at this time.

Then, when at time t1 the potential of the driving line DRi is changed to a low level, the switching TFT 925 is changed to a non-conduction state. Thus, a current flowing through the organic EL element 928 from the power supply wiring line Vp is interrupted. Instead of this, a current flows into the connection point A from the power supply wiring line Vp through the driving TFT 921 and the switching TFT 924, and the potential at the connection point A (which is equal to the source terminal potential of the driving TFT 921) rises while the driving TFT 921 is in a conduction state. Accordingly, the gate-source voltage of the driving TFT 921 drops and when this voltage becomes a threshold voltage Vth (positive value) (i.e., the source terminal potential becomes (Vpc−Vth)), the driving TFT 921 is changed to a non-conduction state. Hence, the potential at the connection point A rises to (Vpc−Vth).

Then, when at time t2 the potential of the auto-zero line AZi is changed to a low level, the switching TFTs 923 and 924 are changed to a non-conduction state. At this time, a potential difference Vth between the gate terminal of the driving TFT 921 and the connection point A is held in the capacitor 926.

Then, when at time t3 the potential of the scanning line Gi is changed to a high level, the switching TFT 922 is changed to a conduction state. In addition, at time t3, the potential of the data line Sj is changed from a data potential Va for the last time (a data potential written to a pixel circuit in an adjacent upper row) to a data potential Vdata. Thus, the potential at the connection point A is changed from (Vpc−Vth) to Vdata, and accordingly, the gate terminal potential of the driving TFT 921 is changed by the same amount (Vdata−Vpc+Vth) and thus becomes (Vdata+Vth).

Then, when at time t4 the potential of the scanning line Gi is changed to a low level, the switching TFT 922 is changed to a non-conduction state. At this time, a potential difference (VDD−Vdata) between the connection point A and the power supply wiring line Vp is held in the capacitor 927. Then, at time t5, the potential of the data line Sj is changed to a data potential Vb for the next time (a data potential to be written to a pixel circuit in an adjacent lower row).

Then, when at time t6 the potential of the driving line DRi is changed to a high level, the switching TFT 925 is changed to a conduction state. Thus, a current flows through the organic EL element 928 from the power supply wiring line Vp through the driving TFT 921 and the switching TFT 925. Although the amount of current flowing through the driving TFT 921 increases or decreases depending on the gate terminal potential (Vdata+Vth), even when the threshold voltage Vth is different, if the data potential Vdata is the same, then the amount of current is the same. Therefore, regardless of the value of the threshold voltage Vth, a current of an amount according to the data potential Vdata flows through the organic EL element 928 and thus the organic EL element 928 emits light with a luminance according to the data potential Vdata.

As such, according to the pixel circuit 920, as with the pixel circuit 910, variations in the threshold voltage of the driving TFT 921 can be compensated for and thus the organic EL element 928 is allowed to emit light with a desired luminance. In addition, since the gate-source voltage of the driving TFT 921 can be set to the threshold voltage Vth without bringing the switching TFT 922 into a conduction state, variations in the threshold voltage of the driving TFT 921 can be compensated for even during times other than the period (one horizontal scanning period) during which the potential of the scanning line Gi is brought to a high level.

FIG. 19 is a circuit diagram of a pixel circuit described in Non-Patent Document 1. A pixel circuit 930 shown in FIG. 19 includes a driving TFT 931, switching TFTs 932 to 935, capacitors 936 and 937, and an organic EL element 938. All of the TFTs included in the pixel circuit 930 are of an n-channel type.

In the pixel circuit 930, the switching TFT 935, the driving TFT 931, and the organic EL element 938 are provided in series between a power supply wiring line Vp (potential is VDD) and a common cathode Vcom. The capacitor 936 and the switching TFT 932 are provided in series between a gate terminal of the driving TFT 931 and a data line Sj. Hereinafter, a connection point between the capacitor 936 and the switching TFT 932 is referred to as A, a connection point between the driving TFT 931 and the organic EL element 938 is referred to as B, and the potential at the connection point B is Vs. The switching TFT 933 is provided between the connection point A and a power supply wiring line Vr (potential is Vref), the switching TFT 934 is provided between the gate and drain terminals of the driving TFT 931, and the capacitor 937 is provided between the connection point A and the power supply wiring line Vp. A gate terminal of the switching TFT 932 is connected to a scanning line Gi, gate terminals of the respective switching TFTs 933 and 934 are connected to a scanning line Gi−1, and a gate terminal of the switching TFT 935 is connected to a control line Ci.

FIG. 20 is a timing chart of the pixel circuit 930. Before time t0, the potentials of the scanning lines Gi and Gi−1 are controlled to a low level and the potential of the control line Ci is controlled to a high level. When at time t0 the potential of the scanning line Gi−1 is changed to a high level, the switching TFTs 933 and 934 are changed to a conduction state. Thus, the gate and drain terminals of the driving TFT 931 are equal in potential and the potential at the connection point A is changed to Vref.

Then, when at time t1 the potential of the control line Ci is changed to a low level, the switching TFT 935 is changed to a non-conduction state. Thus, a current flowing through the organic EL element 938 from the power supply wiring line Vp through the switching TFT 935 and the driving TFT 931 is interrupted. Instead of this, a current flows through the organic EL element 938 from the gate terminal of the driving TFT 931 through the switching TFT 934 and the driving TFT 931 and the gate terminal potential of the driving TFT 931 drops while the driving TFT 931 is in a conduction state. The driving TFT 931 is changed to a non-conduction state when the gate-source voltage becomes a threshold voltage Vth (positive value) (i.e., the gate terminal potential becomes (Vs+Vth)). Therefore, the gate terminal potential of the driving TFT 931 drops to (Vs+Vth).

Then, when at time t2 the potential of the scanning line Gi−1 is changed to a low level, the switching TFTs 933 and 934 are changed to a non-conduction state. At this time, a potential difference (Vp−Vs−Vth) between the gate terminal of the driving TFT 931 and the connection point A is held in the capacitor 936. Thereafter, when the potential of the scanning line Gi is changed to a high level, the switching TFT 932 is changed to a conduction state. Also, in accordance with the change in the potential of the scanning line Gi, the potential of the data line Sj is changed from a data potential Vdata0 for the last time (a data potential written to a pixel circuit in an adjacent upper row) to a data potential Vdata for this time. Thus, the potential at the connection point A is changed from Vref to Vdata, and accordingly, the gate terminal potential of the driving TFT 931 is changed by the same amount (Vdata−Vref) and thus becomes (Vdata−Vref+Vs+Vth). Thereafter, when the potential of the scanning line Gi is changed to a low level, the switching TFT 932 is changed to a non-conduction state.

Then, when at time t3 the potential of the control line Ci is changed to a high level, the switching TFT 935 is changed to a conduction state. Thus, a current flows through the organic EL element 938 from the power supply wiring line Vp through the switching TFT 935 and the driving TFT 931. Although the amount of current flowing through the driving TFT 931 increases or decreases depending on the gate terminal potential (Vdata−Vref+Vs+Vth), even when the threshold voltage Vth is different, if the potential difference (Vdata−Vref) is the same, then the amount of current is the same. Therefore, regardless of the value of the threshold voltage Vth, a current of an amount according to the potential Vdata flows through the organic EL element 938 and thus the organic EL element 938 emits light with a luminance according to the data potential Vdata.

As such, according to the pixel circuit 930, as with the pixel circuits 910 and 920, variations in the threshold voltage of the driving TFT 931 can be compensated for and thus the organic EL element 938 is allowed to emit light with a desired luminance. In addition, since, as with the pixel circuit 920, the gate-source voltage of the driving TFT 931 can be set to the threshold voltage Vth without bringing the switching TFT 932 into a conduction state, variations in the threshold voltage of the driving TFT 931 can be compensated for even during times other than the period (one horizontal scanning period) during which the potential of the scanning line Gi is brought to a high level.

[Patent Document 1] International Publication Pamphlet No. WO 98/48403

[Patent Document 2] Japanese Patent Application Laid-Open No. 2005-338591

[Non-Patent Document 1] "A 14.1 inch Full Color AMOLED Display with Top Emission Structure and a-Si TFT Backplane", SID '05 Digest, pp. 1538-1541

DISCLOSURE OF THE INVENTION

Problems to be Solved by the Invention

However, the above-described conventional pixel circuits have problems shown below. The pixel circuit 910 (FIG. 15) has a problem that there is a limit to the length of a period during which variations in the threshold voltage of the driving TFT are compensated for. In the pixel circuit 910, while the potential of the scanning line Gi is at a low level, the potential of the data line Sj needs to be changed from Vstd to Vdata after setting the gate terminal potential of the driving TFT 911 to a potential (VDD+Vth) for a threshold state. For example, when the resolution of a screen is VGA (640×480 pixels), the number of scanning lines Gi is 480, and the frame frequency is 60 Hz, the length of a period during which the potential of a scanning line Gi is at a low level is about 34.7 μs at the longest. It is extremely difficult to change, during such a short period of time, the potential of the data line Sj from Vstd to Vdata after setting the potential of the gate terminal of the driving TFT 911 to (VDD+Vth).

The pixel circuit 920 (FIG. 17) does not have the above-described problem but has a problem that the display quality degrades because the gate terminal potential of the driving TFT 921 is different between the time before the organic EL element 928 emits light (in FIG. 18, before time t6; hereinafter, referred to as the compensation period) and the time when the organic EL element 928 emits light (in FIG. 18, after time t6; hereinafter, referred to as the light emission period). This problem will be described below.

FIG. 21 is a diagram showing a pixel array including a plurality of pixel circuits 920. A pixel array 929 shown in FIG. 21 includes m pixel circuits 920 in a row direction and n pixel circuits 920 in a column direction. Pixel circuits 920 arranged in the same row are connected to one same scanning line and one same control line and pixel circuits 920 arranged in the same column are connected to one same power supply wiring line and one same data line. Note that to facilitate understanding of the drawing, in FIG. 21, data lines are omitted and a scanning line and a control line are depicted as one line.

Generally, for power supply wiring lines Vp, metal wiring lines are used and thus a resistance component occurs in each power supply wiring line Vp between two pixel circuits 920 adjacent to each other in the column direction. When a current flows through the power supply wiring line Vp having such a resistance component, a voltage drop occurs and thus the potential of the power supply wiring line Vp decreases. In the pixel array, pixel circuits farthest from a current supply source are most likely to be affected by the voltage drop. For example, in FIG. 21, when a current is supplied from the upper side of the pixel array 929, pixel circuits An1, An2, . . . , Anm are most likely to be affected by the voltage drop.

FIGS. 22A and 22B are diagrams respectively showing equivalent circuits of the pixel circuit 920 for the compensation period and the light emission period. During the compensation period (FIG. 22A), since the switching TFT 925 is in a non-conduction state, a current does not flow through the pixel circuit 920 from the power supply wiring line Vp (I2=0). On the other hand, during the light emission period (FIG. 22B), since the switching TFT 925 is in a conduction state, a current flows through the pixel circuit 920 from the power supply wiring line Vp (I2≠0).

Hence, the amount of current flowing through a portion of the power supply wiring line Vp that is on the closer side to the current supply source (in FIGS. 22A and 22B, a portion depicted on the upper side of the pixel circuit 920) is larger during the light emission period than during the compensation period and a voltage drop occurring in such a portion is also larger during the light emission period than during the compensation period. Thus, when considering a voltage drop occurring in the power supply wiring line Vp, a power supply voltage to be supplied to the pixel circuit 920 is lower during the light emission period than during the compensation period.

In addition, since the gate terminal of the driving TFT 921 is connected to the power supply wiring line Vp through the capacitors 926 and 927, when the potential of the power supply wiring line Vp fluctuates, the gate terminal potential of the driving TFT 921 fluctuates by the same amount. Specifically, when the potential of the power supply wiring line Vp and the gate terminal potential of the driving TFT 921 during the compensation period are respectively VDDa and Vga and the potential of the power supply wiring line Vp and the gate terminal potential of the driving TFT 921 during the light emission period are respectively VDDb and Vgb, the following equation (1) is established:

$$Vgb=Vga+(VDDb-VDDa) \quad (1).$$

As such, in the pixel circuit 920, a power supply voltage to be supplied to the pixel circuit 920 is different between the compensation period and the light emission period and the gate terminal potential of the driving TFT 921 is also different. Therefore, the amount of current flowing through the driving TFT 921 during the light emission period is different from the amount of current expected during the compensation period. Accordingly, in the pixel circuit 920, the organic EL element 928 cannot emit light with a desired luminance and thus the display quality degrades.

As with the pixel circuit 920, the pixel circuit 930 (FIG. 19) also has a problem that the display quality degrades because the gate terminal potential of the driving TFT 921 is different between the compensation period and the light emission period.

An object of the present invention is therefore to provide a display device that can freely set a period during which variations in the threshold voltage of a drive element are compensated for, and performs high-quality display by holding a control terminal potential of the drive element during light emission from an electro-optical element.

Means for Solving the Problems

A first aspect of the present invention is an electric current driving type display device including:

a plurality of pixel circuits arranged so as to correspond to respective intersections of a plurality of scanning lines and a plurality of data lines;

a scanning signal output circuit that selects a write-target pixel circuit using the scanning line; and a display signal output circuit that provides potentials according to display data to the data lines, wherein each of the pixel circuits includes:

an electro-optical element provided between a first power supply wiring line and a second power supply wiring line;

a drive element provided in series with the electro-optical element and between the first power supply wiring line and the second power supply wiring line;

a first capacitor having a first electrode connected to a control terminal of the drive element;

a first switching element provided between a second electrode of the first capacitor and the data line;

a second switching element provided between the second electrode of the first capacitor and a third power supply wiring line;

a third switching element provided between the control terminal of the drive element and one current input/output terminal of the drive element;

a fourth switching element provided between the first power supply wiring line and the drive element; and a second capacitor having one electrode connected to the third power supply wiring line and having an other electrode connected to any one of the electrodes of the first capacitor.

A second aspect of the present invention is the display device according to the first aspect of the present invention, wherein the pixel circuit further includes a fifth switching element provided between a connection point between the drive element and the electro-optical element, and the third power supply wiring line.

A third aspect of the present invention is the display device according to the first aspect of the present invention, wherein the pixel circuit further includes a fifth switching element provided between a connection point between the drive element and the electro-optical element, and the second power supply wiring line.

A fourth aspect of the present invention is the display device according to the first aspect of the present invention, wherein when writing to the pixel circuit, a potential of the second power supply wiring line is controlled such that an applied voltage to the electro-optical element is lower than a light-emission threshold voltage.

A fifth aspect of the present invention is an electric current driving type display device including:

a plurality of pixel circuits arranged so as to correspond to respective intersections of a plurality of scanning lines and a plurality of data lines;

a scanning signal output circuit that selects a write-target pixel circuit using the scanning line; and a display signal output circuit that provides potentials according to display data to the data lines, wherein each of the pixel circuits includes:

an electro-optical element provided between a first power supply wiring line and a second power supply wiring line;

a drive element provided in series with the electro-optical element and between the first power supply wiring line and the second power supply wiring line;

a first capacitor having a first electrode connected to a control terminal of the drive element;

a first switching element provided between a second electrode of the first capacitor and the data line;

a second switching element provided between the control terminal of the drive element and a third power supply wiring line;

a third switching element provided between the second electrode of the first capacitor and one current input/output terminal of the drive element; and a second capacitor provided between the second electrode of the first capacitor and the third power supply wiring line.

A sixth aspect of the present invention is the display device according to the fifth aspect of the present invention, wherein the pixel circuit further includes a fourth switching element provided between the drive element and the electro-optical element.

A seventh aspect of the present invention is the display device according to the fifth aspect of the present invention, wherein when writing to the pixel circuit, a potential of the second power supply wiring line is controlled such that an applied voltage to the electro-optical element is lower than a light-emission threshold voltage.

An eighth aspect of the present invention is the display device according to the first or fifth aspect of the present invention, wherein the electro-optical element includes an organic EL element.

A ninth aspect of the present invention is the display device according to the first or fifth aspect of the present invention, wherein the drive element and all of the switching elements in the pixel circuit include insulated-gate type field-effect transistors.

A tenth aspect of the present invention is the display device according to the first or fifth aspect of the present invention, wherein the drive element and all of the switching elements in the pixel circuit include thin-film transistors.

An eleventh aspect of the present invention is the display device according to the tenth aspect of the present invention, wherein the thin-film transistors include amorphous silicon.

A twelfth aspect of the present invention is the display device according to the first or fifth aspect of the present invention, wherein all of the switching elements in the pixel circuit include n-channel type transistors.

A thirteenth aspect of the present invention is an pixel circuit, a plurality of which are arranged in an electric current driving type display device so as to correspond to respective intersections of a plurality of scanning lines and a plurality of data lines, the pixel circuit including;

an electro-optical element provided between a first power supply wiring line and a second power supply wiring line;

a drive element provided in series with the electro-optical element and between the first power supply wiring line and the second power supply wiring line;

a first capacitor having a first electrode connected to a control terminal of the drive element;

a first switching element provided between a second electrode of the first capacitor and the data line;

a second switching element provided between the second electrode of the first capacitor and a third power supply wiring line;

a third switching element provided between the control terminal and one current input/output terminal of the drive element;

a fourth switching element provided between the first power supply wiring line and the drive element; and a second capacitor having one electrode connected to the third power supply wiring line and having an other electrode connected to any one of the electrodes of the first capacitor.

A fourteenth aspect of the present invention is a pixel circuit, a plurality of which are arranged in an electric current driving type display device so as to correspond to respective intersections of a plurality of scanning lines and a plurality of data lines, the pixel circuit including;

an electro-optical element provided between a first power supply wiring line and a second power supply wiring line;

a drive element provided in series with the electro-optical element and between the first power supply wiring line and the second power supply wiring line;

a first capacitor having a first electrode connected to a control terminal of the drive element;

a first switching element provided between a second electrode of the first capacitor and the data line;

a second switching element provided between the control terminal of the drive element and a third power supply wiring line;

a third switching element provided between the second electrode of the first capacitor and one current input/output terminal of the drive element; and a second capacitor provided between the second electrode of the first capacitor and the third power supply wiring line.

EFFECT OF THE INVENTION

According to the first aspect of the present invention, by controlling the second switching element connected to the third power supply wiring line to a conduction state, the drive element can be set to a threshold state (a state in which a threshold voltage is applied) without bringing the first switching element connected to the data line into a conduction state. In addition, since a control terminal potential of the drive element is held by the second capacitor having one electrode connected to the third power supply wiring line (or by a circuit made by connecting the first and second capacitors in series), even when a power supply voltage to be supplied to the pixel circuit from the first power supply wiring line varies between when variations in the threshold voltage of the drive element are compensated for and when the electro-optical element emits light, the control terminal potential of the drive element is not affected by this variation. Accordingly, a display device can be obtained that can freely set a period during which variations in the threshold voltage of the drive element are compensated for, and performs high-quality display by holding a control terminal potential of the drive element during light emission from the electro-optical element.

According to the second or third aspect of the present invention, when writing to the pixel circuit, by controlling the fifth switching element to a conduction state, it is possible to allow a current flowing through the drive element to flow through the fifth switching element and to not allow such a current to flow through the electro-optical element. Thus, unwanted light emission from the electro-optical element can be prevented, the contrast of a display screen can be enhanced, and deterioration of the electro-optical element can be suppressed.

According to the fourth aspect of the present invention, when writing to the pixel circuit, by controlling the potential of the second power supply wiring line, it is possible to not allow a current to flow through the electro-optical element. Thus, with a smaller amount of circuit, unwanted light emission from the electro-optical element can be prevented, the contrast of a display screen can be enhanced, and deterioration of the electro-optical element can be suppressed. In addition, by reducing the amplitude of the potential of the second power supply wiring line, the power consumption of the display device can be reduced.

According to the fifth aspect of the present invention, by controlling the second switching element connected to the third power supply wiring line to a conduction state, the drive element can be set to a threshold state without bringing the first switching element connected to the data line into a conduction state. In addition, a control terminal potential of the drive element is held by the second capacitor having one electrode connected to the third power supply wiring line. Therefore, even when a power supply voltage to be supplied to the pixel circuit from the first power supply wiring line varies between when variations in the threshold voltage of the drive element are compensated for and when the electro-optical element emits light, the control terminal potential of the drive element is not affected by this variation. Accordingly, a display device can be obtained that can freely set a period during which variations in the threshold voltage of the drive element are compensated for, and performs high-quality display by holding a control terminal potential of the drive element during light emission from the electro-optical element.

According to the sixth aspect of the present invention, when writing to the pixel circuit, by controlling the fourth switching element to a non-conduction state, it is possible to not allow a current to flow through the electro-optical element from the drive element. Thus, unwanted light emission from the electro-optical element can be prevented, the contrast of a display screen can be enhanced, and deterioration of the electro-optical element can be suppressed.

According to the seventh aspect of the present invention, when writing to the pixel circuit, by controlling the potential of the second power supply wiring line, it is possible to not allow a current to flow through the electro-optical element. Thus, with a smaller amount of circuit, unwanted light emission from the electro-optical element can be prevented, the contrast of a display screen can be enhanced, and deterioration of the electro-optical element can be suppressed. In addition, by reducing the amplitude of the potential of the second power supply wiring line, the power consumption of the display device can be reduced.

According to the eighth aspect of the present invention, an organic EL display can be obtained that can freely set a period during which variations in the threshold voltage of the drive element are compensated for, and performs high-quality display by holding a control terminal potential of the drive element during light emission from the organic EL element.

According to the ninth aspect of the present invention, by using an insulated-gate type field-effect transistor as the drive element, a current flowing through the drive element can be prevented from flowing through the electro-optical element when compensating for variations in the threshold voltage of the drive element. Thus, unwanted light emission from the electro-optical element can be prevented, the contrast of a display screen can be enhanced, and deterioration of the electro-optical element can be suppressed.

According to the tenth aspect of the present invention, by composing the drive element and all switching elements in the pixel circuit using thin-film transistors, the display device can be easily fabricated with high precision.

According to the eleventh aspect of the present invention, since a period during which variations in the threshold voltage of the drive element are compensated for can be freely set, the thin-film transistors can be composed using amorphous silicon whose mobility is lower than that of low-temperature polycrystalline silicon or CG silicon and which requires time to perform the process of compensating for variations in the threshold voltage of the drive element.

According to the twelfth aspect of the present invention, by composing all switching elements in the pixel circuit using n-channel type transistors, all transistors can be fabricated using the same masks and by the same process, and thus, the cost of the display device can be reduced. Also, since transistors of the same channel type can be arranged closer to each other than transistors of different channel types, a saved pixel circuit area can be utilized for other purposes.

According to the thirteenth or fourteenth aspect of the present invention, by controlling the second switching element connected to the third power supply wiring line to a conduction state, the drive element can be set to a threshold state without bringing the first switching element connected to the data line into a conduction state. In addition, since a control terminal potential of the drive element is held by the second capacitor having one electrode connected to the third power supply wiring line (or by a circuit made by connecting the first capacitor and the second capacitor in series), even when a power supply voltage to be supplied to the pixel circuit from the first power supply wiring line varies between when variations in the threshold voltage of the drive element are compensated for and when the electro-optical element emits light, the control terminal potential of the drive element is not affected by this variation. Accordingly, a pixel circuit can be obtained which is included in a display device that can freely set a period during which variations in the threshold voltage of the drive element are compensated for, and performs high-quality display by holding a control terminal potential of the drive element during light emission from the electro-optical element.

DESCRIPTION OF THE REFERENCE NUMERALS

10: DISPLAY DEVICE
11: DISPLAY CONTROL CIRCUIT
12: GATE DRIVER CIRCUIT
13: SOURCE DRIVER CIRCUIT
21: SHIFT REGISTER
22: REGISTER
23: LATCH CIRCUIT
24: D/A CONVERTER
100, 200, 300, 400, 500, 600, 700, 150, 450, and 750: PIXEL CIRCUIT
110, 210, 310, 410, 510, 610, and 710: DRIVING TFT
111 to 114, 211 to 215, 311 to 315, 411 to 414, 511 to 515, 611 to 615, and 711 to 714: SWITCHING TFT
121, 122, 221, 222, 321, 322, 421, 422, 521, 522, 621, 622, 721, and 722: CAPACITOR
130, 230, 330, 430, 530, 630, and 730: ORGANIC EL ELEMENT
Vp and Vr: POWER SUPPLY WIRING LINE
Vcom: COMMON CATHODE
CAi: CATHODE WIRING LINE
Wi and Ri: CONTROL LINE
Gi: SCANNING LINE
Sj: DATA LINE

BEST MODE FOR CARRYING OUT THE INVENTION

Display devices according to first to tenth embodiments of the present invention will be described below with reference to FIGS. 1 to 14. A display device according to each embodiment includes a pixel circuit including an electro-optical element, a drive element, a capacitor, and a plurality of switching elements. The pixel circuit includes an organic EL element as the electro-optical element; and a driving TFT and switching TFTs which are composed of CG silicon TFTs as the drive element and the switching elements Note that the drive element and the switching elements can be composed of, for example, amorphous silicon TFTs or low-temperature polysilicon TFTs, in addition to CG silicon TFTs. By composing the drive element and the switching elements using TFTs, the pixel circuit can be easily fabricated with high precision.

The configuration of a CG silicon TFT is disclosed in Inukai, and seven others, "4.0-in. TFT-OLED Displays and a Novel Digital Driving Method", SID '00 Digest, pp. 924-927. A CG silicon TFT fabrication process is disclosed in Takayama, and five others, "Continuous Grain Silicon Technology and Its Applications for Active Matrix Display", AMD-LCD 2000, pp. 25-28. The configuration of an organic EL element is disclosed in Friend, "Polymer Light-Emitting Diodes for use in Flat Panel Display", AM-LCD '01, pp. 211-214. Hence, description of these matters is omitted.

Figure 1:
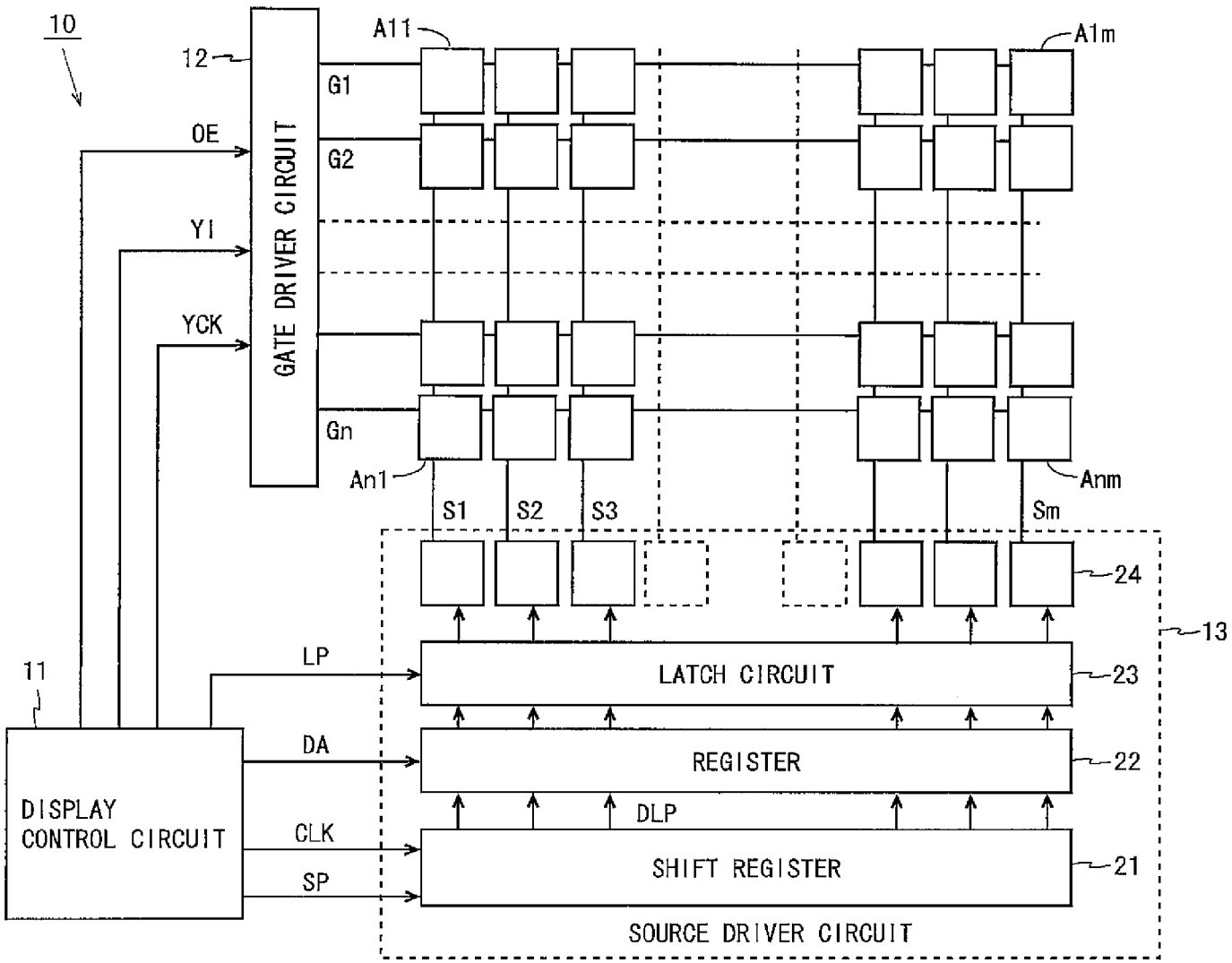
FIG. 1 is a block diagram showing a configuration of a display device according to first to tenth embodiments of the present invention.

FIG. 1 is a block diagram showing a configuration of a display device according to the first to tenth embodiments of the present invention. A display device 10 shown in FIG. 1 includes a plurality of pixel circuits Aij (i is an integer greater than or equal to 1 and less than or equal to n and j is an integer greater than or equal to 1 and less than or equal to m); a display control circuit 11; a gate driver circuit 12; and a source driver circuit 13. In the display device 10, a plurality of scanning lines Gi parallel to one another and a plurality of data lines Sj parallel to one another and orthogonal to the scanning lines Gi are provided. The pixel circuits Aij are arranged in a matrix form so as to correspond to respective intersections of the scanning lines Gi and the data lines Sj.

In addition, in the display device 10, a plurality of control lines (Wi and Ri which are not shown) parallel to one another are arranged in parallel to the scanning lines Gi. The scanning lines Gi and the control lines are connected to the gate driver circuit 12 and the data lines Sj are connected to the source driver circuit 13. The gate driver circuit 12 and the source driver circuit 13 function as drive circuits for the pixel circuits Aij.

The display control circuit 11 outputs a timing signal OE, a start pulse YI, and a clock YCK to the gate driver circuit 12 and outputs a start pulse SP, a clock CLK, display data DA, and a latch pulse LP to the source driver circuit 13.

The gate driver circuit 12 includes a shift register circuit, a logic operation circuit, and a buffer (none of which are shown). The shift register circuit sequentially transfers the start pulse YI in synchronization with the clock YCK. The logic operation circuit performs a logic operation between a pulse outputted from each stage of the shift register circuit and the timing signal OE. An output from the logic operation circuit is provided to a corresponding scanning line Gi and corresponding control lines Wi, Ri through the buffer. As such, the gate driver circuit 12 functions as a scanning signal output circuit that selects a write-target pixel circuit using a corresponding scanning line Gi.

The source driver circuit 13 includes an m-bit shift register 21, a register 22, a latch circuit 23, and m D/A converters 24. The shift register 21 includes m cascade-connected one-bit registers. The shift register 21 sequentially transfers the start pulse SP in synchronization with the clock CLK and outputs timing pulses DLP from the registers of the respective stages. In accordance with output timing of the timing pulses DLP, the display data DA is supplied to the register 22. The register 22 stores the display data DA according to the timing pulses DLP. When an amount of the display data DA corresponding to one row is stored in the register 22, the display control circuit 11 outputs the latch pulse LP to the latch circuit 23. When the latch circuit 23 receives the latch pulse LP, the latch circuit 23 holds the display data stored in the register 22. The D/A converters 24 are provided to the data lines Sj on a one-to-one basis. The D/A converters 24 convert the display data held in the latch circuit 23 to analog signal voltages and provide the analog signal voltages to corresponding data lines Sj. As such, the source driver circuit 13 functions as a display signal output circuit that provides potentials according to display data to the data lines Sj.

Note that although here the source driver circuit 13 is a line sequential scanning type circuit that simultaneously supplies display data for one row to pixel circuits connected to one scanning line, the source driver circuit 13 may be a dot sequential scanning type circuit that sequentially supplies data to each pixel circuit. The configuration of a dot sequential scanning type source driver circuit is the same as that used for polysilicon TFT liquid crystal, etc., and thus description thereof is omitted here. Note also that in order for the display device 10 to achieve reduction in size and cost, it is desirable that all or part of the gate driver circuit 12 and the source driver circuit 13 be formed on the same substrate as that for the pixel circuits Aij, using CG silicon TFTs, polycrystalline silicon TFTs, etc.

Although not shown in FIG. 1, in a region where the pixel circuits Aij are arranged, power supply wiring lines Vp, a common cathode Vcom (or a cathode wiring line CAi), and power supply wiring lines Vr are arranged to supply a power supply voltage to the pixel circuits Aij.

The pixel circuits Aij included in the display device according to each embodiment will be described in detail below. In the following description, a high-level potential provided to a gate terminal of a switching TFT is referred to as GH and a low-level potential is referred to as GL. Also, although in the following description the channel type of each TFT is fixedly determined, provided that an appropriate control signal can be supplied to a gate terminal of each TFT, each TFT may be of either a p-channel type or an n-channel type.

First Embodiment

Figure 2:
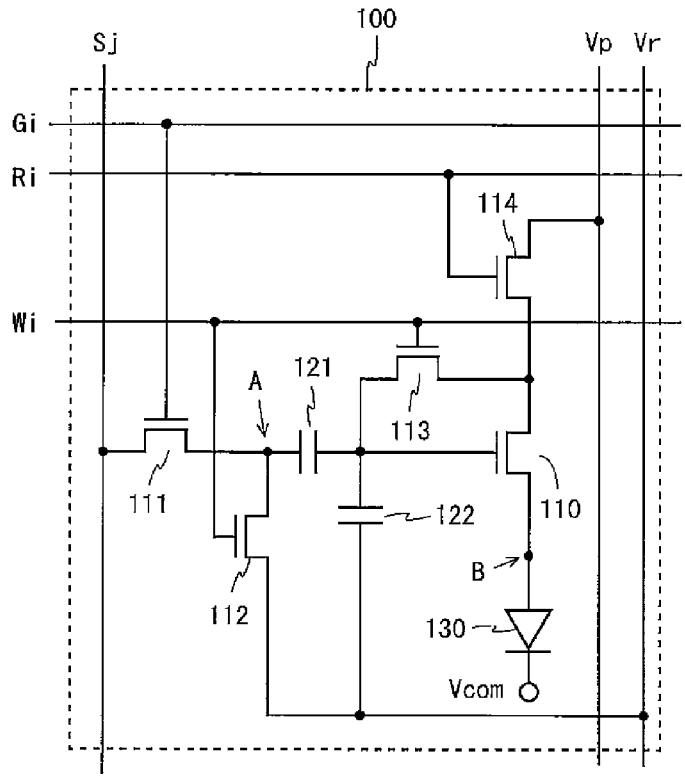
FIG. 2 is a circuit diagram of a pixel circuit included in a display device according to the first embodiment of the present invention.

FIG. 2 is a circuit diagram of a pixel circuit included in a display device according to the first embodiment of the present invention. A pixel circuit 100 shown in FIG. 2 includes a driving TFT 110, switching TFTs 111 to 114, capacitors 121 and 122, and an organic EL element 130. All of the TFTs included in the pixel circuit 100 are of an n-channel type.

The pixel circuit 100 is connected to power supply wiring lines Vp and Vr, a common cathode Vcom, a scanning line Gi, control lines Wi and Ri, and a data line Sj. Of them, to the power supply wiring line Vp (first power supply wiring line) and the common cathode Vcom (second power supply wiring line) are respectively applied fixed potentials VDD and VSS (note that VDD>VSS) and to the power supply wiring line Vr (third power supply wiring line) is applied a predetermined potential Vref. The common cathode Vcom serves as a common electrode for all organic EL elements 130 in the display device.

In the pixel circuit 100, on a path connecting the power supply wiring line Vp to the common cathode Vcom, in order from the side of the power supply wiring line Vp, the switching TFT 114, the driving TFT 110, and the organic EL element 130 are provided in series. One electrode of the capacitor 121 is connected to a gate terminal of the driving TFT 110. Between the other electrode of the capacitor 121 and the data line Sj, the switching TFT 111 is provided. Hereinafter, a connection point between the capacitor 121 and the switching TFT 111 is referred to as A, a connection point between the driving TFT 110 and the organic EL element 130 is referred to as B, and the potential at the connection point B is Vs. The switching TFT 112 is provided between the connection point A and the power supply wiring line Vr, the switching TFT 113 is provided between the gate and drain terminals of the driving TFT 110, and the capacitor 122 is provided between the gate terminal of the driving TFT 110 and the power supply wiring line Vr.

A gate terminal of the switching TFT 111 is connected to the scanning line Gi, gate terminals of the respective switching TFTs 112 and 113 are connected to the control line Wi, and a gate terminal of the switching TFT 114 is connected to the control line Ri. The potentials of the scanning line Gi and the control lines Wi and Ri are controlled by the gate driver circuit 12 and the potential of the data line Sj is controlled by the source driver circuit 13.

Figure 3:
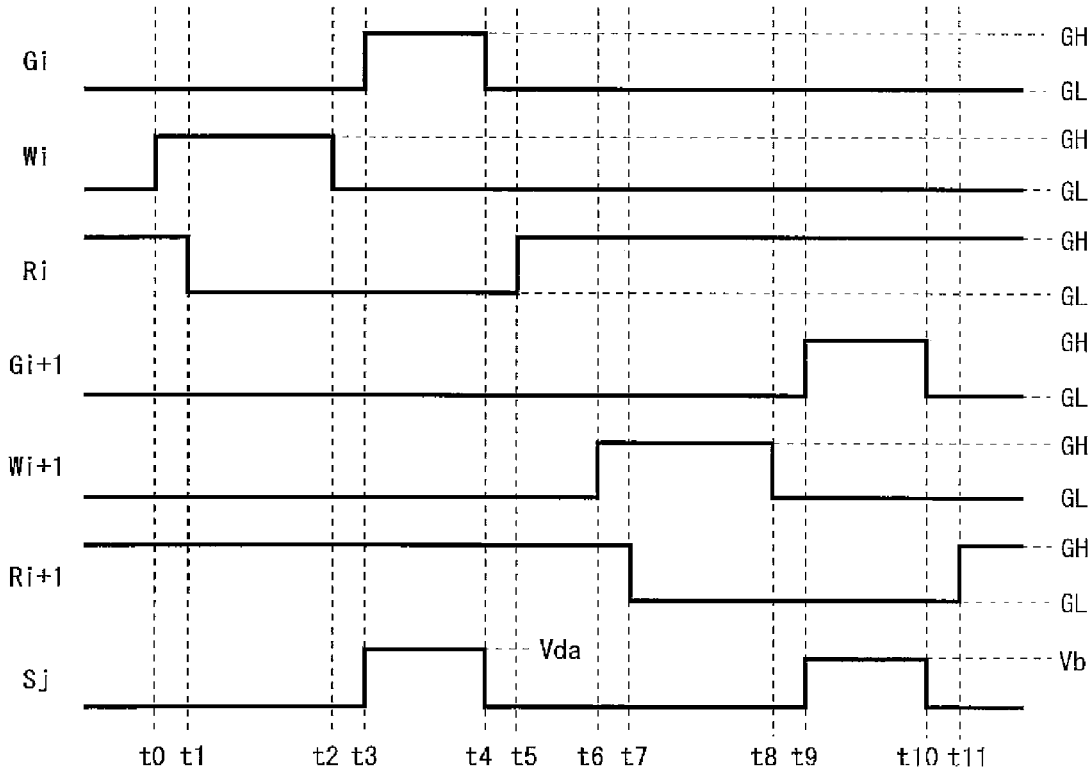
FIG. 3 is a timing chart of a pixel circuit of a display device according to the first to seventh embodiments of the present invention.

FIG. 3 is a timing chart of the pixel circuit 100. FIG. 3 shows changes in potentials applied to the scanning line Gi, the control lines Wi and Ri, and the data line Sj and changes in potentials applied to a scanning line Gi+1 and control lines Wi+1 and Ri+1. Note that the scanning line Gi+1 and the control lines Wi+1 and Ri+1 are signal lines connected to a pixel circuit A(i+1)j in an adjacent lower row. With reference to FIG. 3, the operation of the pixel circuit 100 will be described below.

Before time t0, the potentials of the scanning line Gi and the control line Wi are controlled to GL (low level) and the potential of the control line Ri is controlled to GH (high level). Thus, the switching TFT 114 is in a conduction state and the switching TFTs 111 to 113 are in a non-conduction state. At this time, since the driving TFT 110 is in a conduction state, a current flows through the organic EL element 130 from the power supply wiring line Vp through the switching TFT 114 and the driving TFT 110 and thus the organic EL element 130 emits light.

When at time t0 the potential of the control line Wi is changed to GH, the switching TFTs 112 and 113 are changed to a conduction state. Thus, the connection point A is connected to the power supply wiring line Vr through the switching TFT 112 and thus the potential at the connection point A is changed to Vref. Also, since the gate terminal of the driving TFT 110 is connected to the power supply wiring line Vp through the switching TFTs 113 and 114, the gate terminal potential of the driving TFT 110 is changed to VDD.

Then, when at time t1 the potential of the control line Ri is changed to GL, the switching TFT 114 is changed to a non-conduction state. Thus, the current flowing through the organic EL element 130 from the power supply wiring line Vp is interrupted. Instead of this, a current flows out to the organic EL element 130 from the gate terminal of the driving TFT 110 through the switching TFT 113 and the driving TFT 110, and the gate terminal potential of the driving TFT 110 drops while the driving TFT 110 is in a conduction state. The driving TFT 110 is changed to a non-conduction state when the gate-source voltage becomes a threshold voltage Vth (positive value) (i.e., the gate terminal potential becomes (Vs+Vth)). Therefore, the gate terminal potential of the driving TFT 110 drops to (Vs+Vth) and the driving TFT 110 goes into a threshold state (a state in which a threshold voltage is applied between the gate and the source terminals).

Then, when at time t2 the potential of the control line Wi is changed to GL, the switching TFTs 112 and 113 are changed to a non-conduction state. At this time, a potential difference (Vs+Vth−Vref) between the gate terminal of the driving TFT 110 and the connection point A is held in the capacitor 121.

Then, when at time t3 the potential of the scanning line Gi is changed to GH, the switching TFT 111 is changed to a conduction state and the connection point A is connected to the data line Sj through the switching TFT 111. Also, while the potential of the scanning line Gi is GH, the potential of the data line Sj is controlled to a potential according to display data (hereinafter, referred to as the data potential Vda). Therefore, at time t3, the potential at the connection point A is changed from Vref to Vda. Accordingly, the gate terminal potential of the driving TFT 110 is changed by the same amount (Vda−Vref) and thus becomes (Vs+Vth−Vref+Vda).

Then, when at time t4 the potential of the scanning line Gi is changed to GL, the switching TFT 111 is changed to a non-conduction state. At this time, a potential difference (Vs+Vth−2×Vref+Vda) between the gate terminal of the driving TFT 110 and the power supply wiring line Vr is held in the capacitor 122.

Then, when at time t5 the potential of the control line Ri is changed to GH, the switching TFT 114 is changed to a conduction state. Thus, a current flows through the organic EL element 130 from the power supply wiring line Vp through the switching TFT 114 and the driving TFT 110. Although the amount of current flowing through the driving TFT 110 increases or decreases depending on the gate terminal potential (Vs+Vth−Vref+Vda), even when the threshold voltage Vth is different, if the potential difference (Vda−Vref) is the same, then the amount of current is the same. Therefore, regardless of the value of the threshold voltage Vth of the driving TFT 110, a current of an amount according to the data potential Vda flows through the organic EL element 130 and thus the organic EL element 130 emits light with a specified luminance. Note that since the driving TFT 110 is of an n-channel type, if Vda≧Vref is satisfied, then the higher the data potential Vda the larger the amount of current flowing through the driving TFT 110 and thus the organic EL element 130 emits light more brightly.

Then, after time t6, a write is performed on a pixel circuit in an adjacent lower row (a pixel circuit connected to the scanning line Gi+1). In this case, while the potential of the scanning line Gi+1 is GH (the period from time t9 to time t10), the potential of the data line Sj is controlled to a data potential Vb according to display data (a data potential to be written to the pixel circuit in the adjacent lower row). The data potential Vb may be smaller or larger than the data potential Vda and may be equal to the data potential Vda. This point applies also to embodiments shown below (see FIGS. 11 and 14 which will be described later).

Although in the timing chart shown in FIG. 3 the scanning line Gi+1 is selected after the scanning line Gi, a scanning line to be selected after the scanning line Gi may be another one. In this case, a pixel circuit on which a write is to be performed after the pixel circuit connected to the scanning line Gi is one arranged in any row other than an adjacent lower row of the pixel circuit. For example, in the case where the scanning lines are sequentially selected every other row, a pixel circuit on which a write is to be performed after the pixel circuit connected to the scanning line Gi is one connected to a scanning line Gi+2. This point also applies to the embodiments shown below.

As described above, in the pixel circuit 100, by controlling the switching TFT 112 connected to the power supply wiring line Vr to a conduction state, the driving TFT 110 can be set to a threshold state without bringing the switching TFT 111 connected to the data line Sj into a conduction state. In addition, since a gate terminal potential of the driving TFT 110 is held by the capacitor 122 having one electrode connected to the power supply wiring line Vr, even when a power supply voltage to be supplied to the pixel circuit 100 from the power supply wiring line Vp varies between when variations in the threshold voltage of the driving TFT 110 are compensated for (hereinafter, referred to as the compensation period) and when the organic EL element 130 emits light (hereinafter, referred to as the light emission period), the gate terminal potential of the driving TFT 110 is not affected by this variation.

Therefore, according to the display device according to the present embodiment, a period during which variations in the threshold voltage of the driving TFT are compensated for can be freely set and high-quality display can be performed by holding a gate terminal potential of the driving TFT during light emission from the organic EL element.

In addition, since the display device according to the present embodiment obtains the effect of being able to freely set a period during which variations in the threshold voltage of the drive element are compensated for, TFTs can be composed using amorphous silicon whose mobility is lower than that of low-temperature polycrystalline silicon or CG silicon and which requires time to perform the process of compensating for variations in the threshold voltage of the drive element.

All TFTs included in the pixel circuit 100 are of an n-channel type. By thus composing the drive element and all switching elements in the pixel circuit using transistors of the same channel type, all transistors can be fabricated using the same masks and by the same process, and thus, the cost of the display device can be reduced. Also, since transistors of the same channel type can be arranged closer to each other than transistors of different channel types, a saved pixel circuit area can be utilized for other purposes.

Second Embodiment

Figure 4:
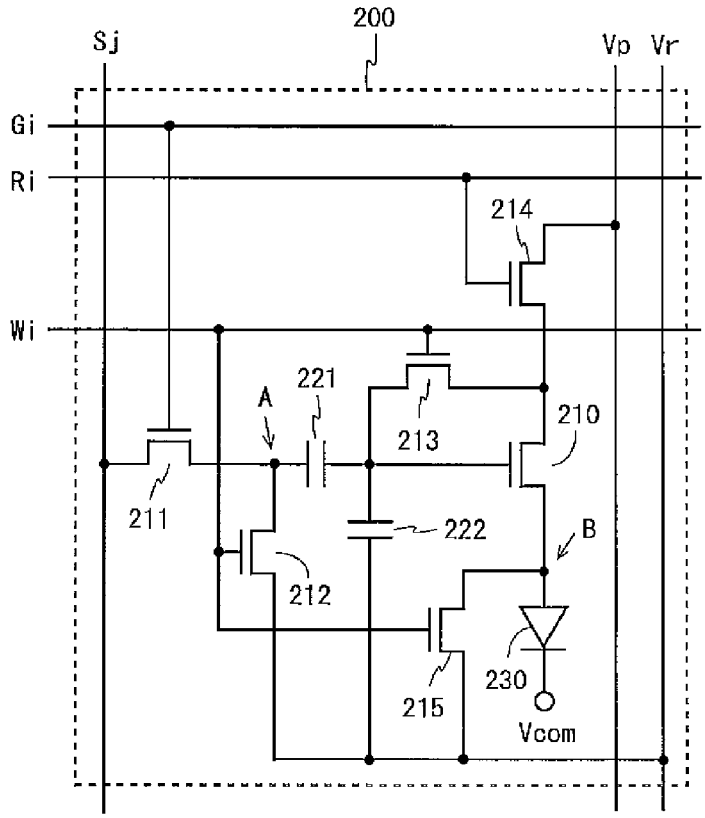
FIG. 4 is a circuit diagram of a pixel circuit included in a display device according to the second embodiment of the present invention.

FIG. 4 is a circuit diagram of a pixel circuit included in a display device according to the second embodiment of the present invention. A pixel circuit 200 shown in FIG. 4 includes a driving TFT 210, switching TFTs 211 to 215, capacitors 221 and 222, and an organic EL element 230. All of the TFTs included in the pixel circuit 200 are of an n-channel type.

The pixel circuit 200 is one such that the switching TFT 215 is added to the pixel circuit 100 (FIG. 2) according to the first embodiment. The switching TFT 215 is provided between a connection point B (connection point between the driving TFT 210 and the organic EL element 230) and a power supply wiring line Vr, and a gate terminal of the switching TFT 215 is connected to a control line Wi. Except for the above point, the configuration of the pixel circuit 200 is the same as that of the pixel circuit 100.

As with the pixel circuit 100, the pixel circuit 200 operates according to the timing chart shown in FIG. 3. As shown in FIG. 3, the potential of the control line Wi is controlled to GH during the period from time t0 to time t2 and controlled to GL during other times. Therefore, the switching TFT 215 is in a conduction state during the period from time t0 to time t2 and is in a non-conduction state during other times. Since, while the switching TFT 215 is in a conduction state, the connection point B is connected to the power supply wiring line Vr through the switching TFT 215, the potential at the connection point B is Vref.

In the present embodiment, the potential Vref is determined such that a voltage to be applied to the organic EL element 230 becomes a reverse bias (alternatively, the voltage becomes lower than a light-emission threshold voltage of the organic EL element 230). By using the potential Vref that satisfies such a condition, during the period from time t0 to time t2, a current flowing through the connection point B from a power supply wiring line Vp through the switching TFT 214 and the driving TFT 210 flows through the switching TFT 215 but does not flow through the organic EL element 230. Hence, in the pixel circuit 200, the organic EL element 230 does not emit light upon writing. Except for the above points, the operation of the pixel circuit 200 is the same as that of the pixel circuit 100.

Thus, according to the display device according to the present embodiment, the same effects (of being able to freely set a period during which variations in the threshold voltage of the driving TFT are compensated for, and performing high-quality display by holding a gate terminal potential of the driving TFT during light emission from the organic EL element) as those obtained in the first embodiment can be obtained, and unwanted light emission from the organic EL element 230 can be prevented, the contrast of a display screen can be enhanced, and the lifetime of the organic EL element 230 can be extended.

Third Embodiment

Figure 5:
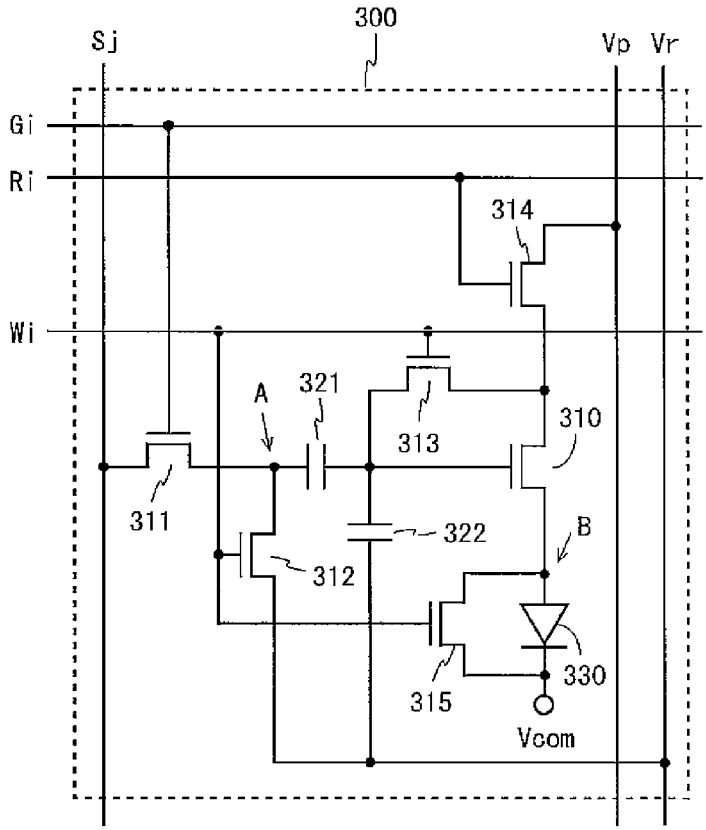
FIG. 5 is a circuit diagram of a pixel circuit included in a display device according to the third embodiment of the present invention.

FIG. 5 is a circuit diagram of a pixel circuit included in a display device according to the third embodiment of the present invention. A pixel circuit 300 shown in FIG. 5 includes a driving TFT 310, switching TFTs 311 to 315, capacitors 321 and 322, and an organic EL element 330. All of the TFTs included in the pixel circuit 300 are of an n-channel type.

The pixel circuit 300 is one such that the switching TFT 315 is added to the pixel circuit 100 (FIG. 2) according to the first embodiment. The switching TFT 315 is provided between a connection point B (connection point between the driving TFT 310 and the organic EL element 330) and a common cathode Vcom, and a gate terminal of the switching TFT 315 is connected to a control line Wi. Except for the above point, the configuration of the pixel circuit 300 is the same as that of the pixel circuit 100.

As with the pixel circuit 100, the pixel circuit 300 operates according to the timing chart shown in FIG. 3. As with the second embodiment, the switching TFT 315 is in a conduction state during the period from time t0 to time t2 and is in a non-conduction state during other times. Since, while the switching TFT 315 is in a conduction state, the connection point B is connected to the common cathode Vcom through the switching TFT 315, a current flowing through the connection point B from a power supply wiring line Vp through the switching TFT 314 and the driving TFT 310 flows through the switching TFT 315 but does not flow through the organic EL element 330. Hence, in the pixel circuit 300, the organic EL element 330 does not emit light upon writing. Except for the above points, the operation of the pixel circuit 300 is the same as that of the pixel circuit 100.

Thus, according to the display device according to the present embodiment, the same effects as those obtained in the first embodiment can be obtained, and unwanted light emission from the organic EL element 330 can be prevented, the contrast of a display screen can be enhanced, and the lifetime of the organic EL element 330 can be extended.

Fourth Embodiment

Figure 6:
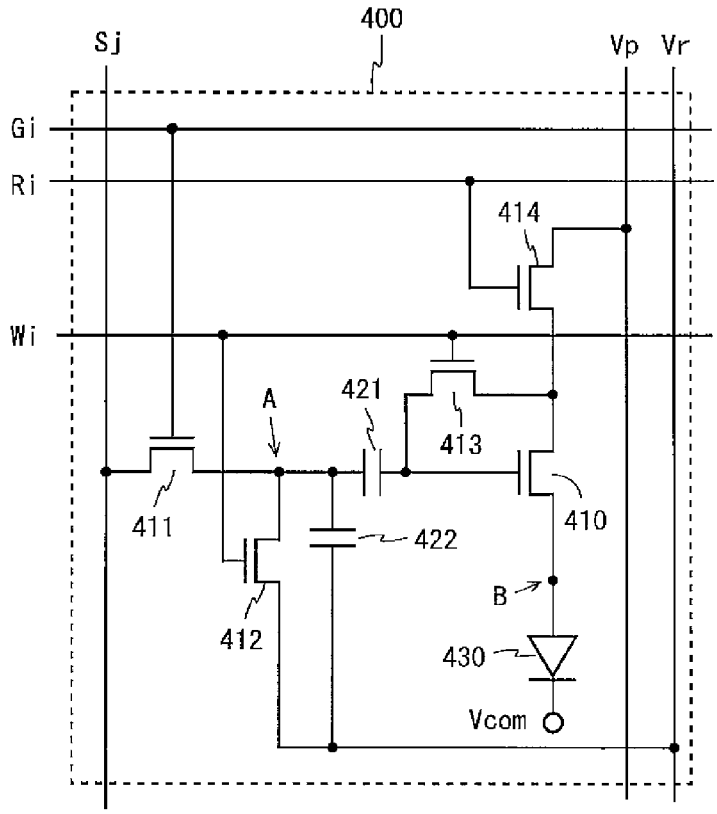
FIG. 6 is a circuit diagram of a pixel circuit included in a display device according to the fourth embodiment of the present invention.

FIG. 6 is a circuit diagram of a pixel circuit included in a display device according to the fourth embodiment of the present invention. A pixel circuit 400 shown in FIG. 6 includes a driving TFT 410, switching TFTs 411 to 414, capacitors 421 and 422, and an organic EL element 430. All of the TFTs included in the pixel circuit 400 are of an n-channel type.

The pixel circuit 400 is one such that in the pixel circuit 100 (FIG. 2) according to the first embodiment the connecting point of the capacitor 122 is changed. In the pixel circuit 400, the capacitor 422 is provided between a connection point A (connection point between the capacitor 421 and the switching TFT 411) and a power supply wiring line Vr and in parallel with the switching TFT 412. Except for the above point, the configuration of the pixel circuit 400 is the same as that of the pixel circuit 100.

As with the pixel circuit 100, the pixel circuit 400 operates according to the timing chart shown in FIG. 3. In the pixel circuit 400, at time t4, a potential difference between a gate terminal of the driving TFT 410 and the power supply wiring line Vr is held in a circuit made by connecting the capacitors 421 and 422 in series. Except for the above point, the operation of the pixel circuit 400 is the same as that of the pixel circuit 100.

As described above, in the pixel circuit 400, by controlling the switching TFT 412 connected to the power supply wiring line Vr to a conduction state, the driving TFT 410 can be set to a threshold state without bringing the switching TFT 411 connected to a data line Sj into a conduction state. In addition, since a gate terminal potential of the driving TFT 410 is held by a circuit made by connecting two capacitors in series and having one terminal connected to the power supply wiring line Vr, even when a power supply voltage to be supplied to the pixel circuit 400 from the power supply wiring line Vp varies between the compensation period and the light emission period, the gate terminal potential of the driving TFT 410 is not affected by this variation. Therefore, according to the display device according to the present embodiment, as with the first embodiment, a period during which variations in the threshold voltage of the driving TFT are compensated for can be freely set and high-quality display can be performed by holding a gate terminal potential of the driving TFT during light emission from the organic EL element.

Fifth Embodiment

Figure 7:
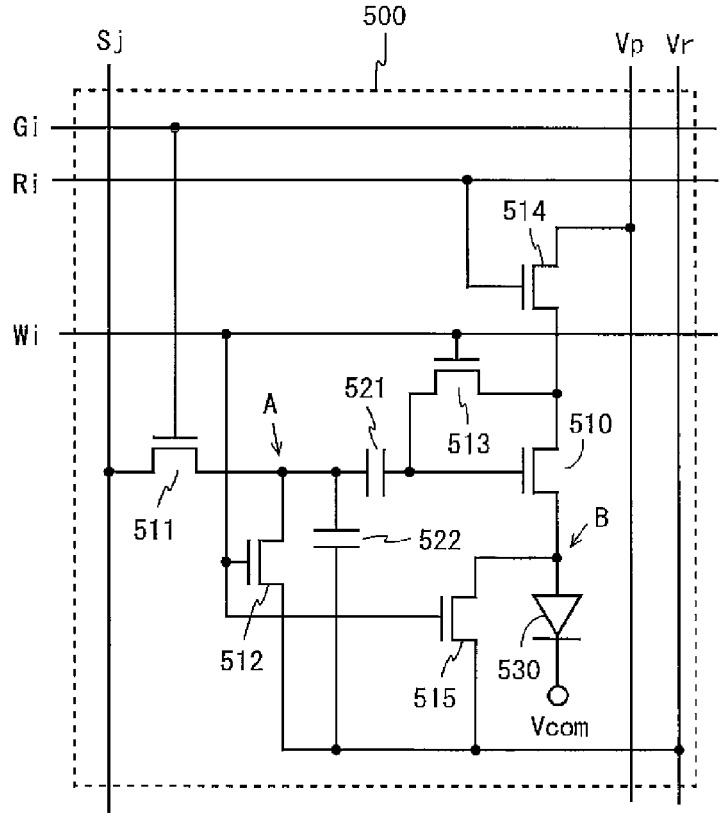
FIG. 7 is a circuit diagram of a pixel circuit included in a display device according to the fifth embodiment of the present invention.

FIG. 7 is a circuit diagram of a pixel circuit included in a display device according to the fifth embodiment of the present invention. A pixel circuit 500 shown in FIG. 7 includes a driving TFT 510, switching TFTs 511 to 515, capacitors 521 and 522, and an organic EL element 530. All of the TFTs included in the pixel circuit 500 are of an n-channel type.

The pixel circuit 500 is one such that the switching TFT 515 is added to the pixel circuit 400 (FIG. 6) according to the fourth embodiment. The switching TFT 515 is provided between a connection point B (connection point between the driving TFT 510 and the organic EL element 530) and a power supply wiring line Vr, and a gate terminal of the switching TFT 515 is connected to a control line Wi. Except for the above point, the configuration of the pixel circuit 500 is the same as that of the pixel circuit 400.

As with the pixel circuit 400, the pixel circuit 500 operates according to the timing chart shown in FIG. 3. As with the second embodiment, the switching TFT 515 is in a conduction state during the period from time t0 to time t2 and is in a non-conduction state during other times. Since, while the switching TFT 515 is in a conduction state, the connection point B is connected to the power supply wiring line Vr through the switching TFT 515, the potential at the connection point B is Vref.

In the present embodiment, the potential Vref is determined such that a voltage to be applied to the organic EL element 530 becomes a reverse bias (alternatively, the voltage becomes lower than a light-emission threshold voltage of the organic EL element 530). By using the potential Vref that satisfies such a condition, during the period from time t0 to time t2, a current flowing through the connection point B from a power supply wiring line Vp through the switching TFT 514 and the driving TFT 510 flows through the switching TFT 515 but does not flow through the organic EL element 530. Hence, in the pixel circuit 500, a current does not flow through the organic EL element 530 upon writing. Except for the above points, the operation of the pixel circuit 500 is the same as that of the pixel circuit 400.

Thus, according to the display device according to the present embodiment, the same effects as those obtained in the first embodiment can be obtained, and unwanted light emission from the organic EL element 530 can be prevented, the contrast of a display screen can be enhanced, and the lifetime of the organic EL element 530 can be extended.

Sixth Embodiment

Figure 8:
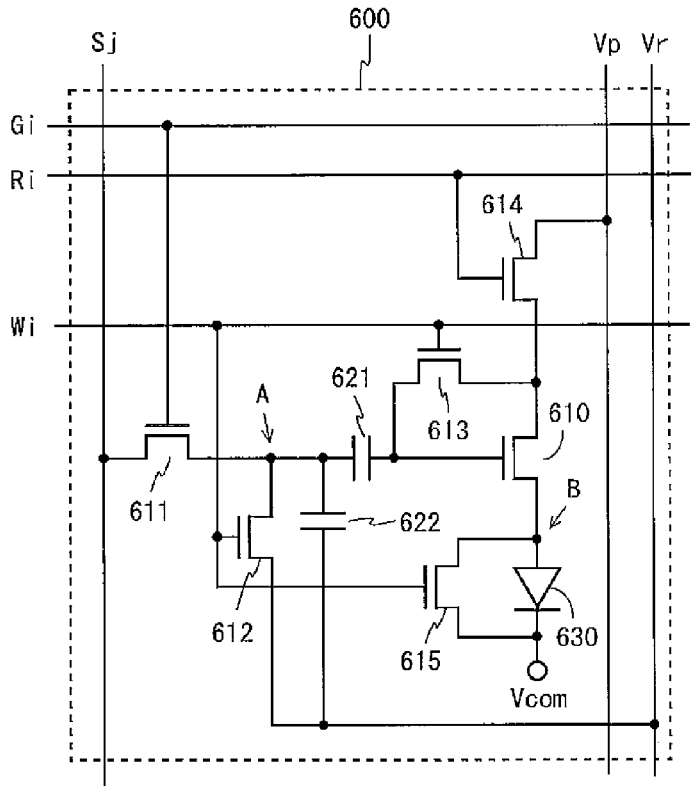
FIG. 8 is a circuit diagram of a pixel circuit included in a display device according to the sixth embodiment of the present invention.

FIG. 8 is a circuit diagram of a pixel circuit included in a display device according to the sixth embodiment of the present invention. A pixel circuit 600 shown in FIG. 8 includes a driving TFT 610, switching TFTs 611 to 615, capacitors 621 and 622, and an organic EL element 630. All of the TFTs included in the pixel circuit 600 are of an n-channel type.

The pixel circuit 600 is one such that the switching TFT 615 is added to the pixel circuit 400 (FIG. 6) according to the fourth embodiment. The switching TFT 615 is provided between a connection point B (connection point between the driving TFT 610 and the organic EL element 630) and a common cathode Vcom, and a gate terminal of the switching TFT 615 is connected to a control line Wi. Except for the above point, the configuration of the pixel circuit 600 is the same as that of the pixel circuit 400.

As with the pixel circuit 400, the pixel circuit 600 operates according to the timing chart shown in FIG. 3. As with the second embodiment, the switching TFT 615 is in a conduction state during the period from time t0 to time t2 and is in a non-conduction state during other times. Since, while the switching TFT 615 is in a conduction state, the connection point B is connected to the common cathode Vcom through the switching TFT 615, a current flowing through the connection point B from a power supply wiring line Vp through the switching TFT 614 and the driving TFT 610 flows through the switching TFT 615 but does not flow through the organic EL element 630. Hence, in the pixel circuit 600, a current does not flow through the organic EL element 630 upon writing. Except for the above points, the operation of the pixel circuit 600 is the same as that of the pixel circuit 400.

Thus, according to the display device according to the present embodiment, the same effects as those obtained in the first embodiment can be obtained, and unwanted light emission from the organic EL element 630 can be prevented, the contrast of a display screen can be enhanced, and the lifetime of the organic EL element 630 can be extended.

Seventh Embodiment

Figure 9:
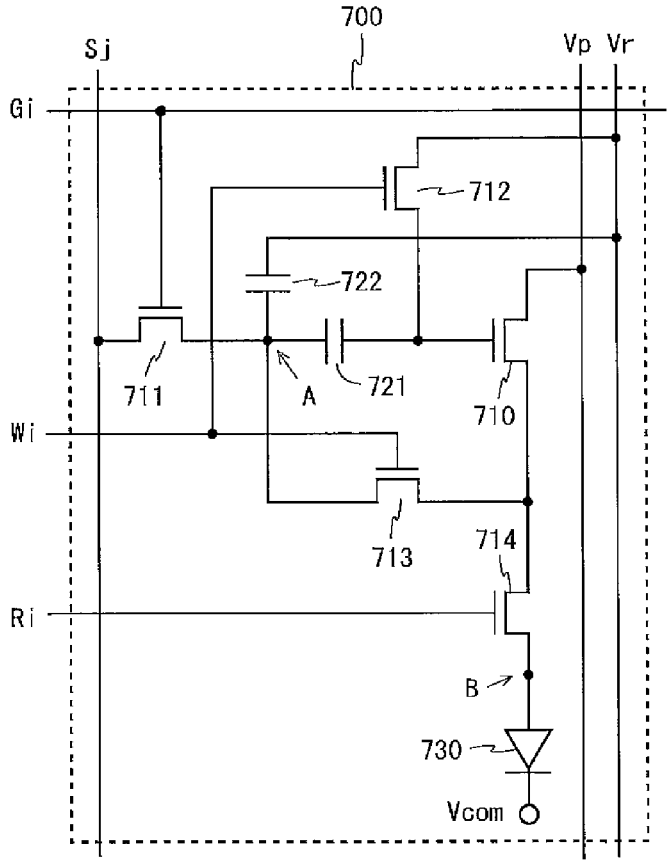
FIG. 9 is a circuit diagram of a pixel circuit included in a display device according to the seventh embodiment of the present invention.

FIG. 9 is a circuit diagram of a pixel circuit included in a display device according to the seventh embodiment of the present invention. A pixel circuit 700 shown in FIG. 9 includes a driving TFT 710, switching TFTs 711 to 714, capacitors 721 and 722, and an organic EL element 730. All of the TFTs included in the pixel circuit 700 are of an n-channel type.

In the pixel circuit 700, on a path connecting a power supply wiring line Vp to a common cathode Vcom, in order from the side of the power supply wiring line Vp, the driving TFT 710, the switching TFT 714, and the organic EL element 730 are provided in series. One electrode of the capacitor 721 is connected to a gate terminal of the driving TFT 710. Between the other electrode of the capacitor 721 and a data line Sj, the switching TFT 711 is provided. Hereinafter, a connection point between the capacitor 721 and the switching TFT 711 is referred to as A, a connection point between the driving TFT 710 and the organic EL element 730 is referred to as B, and the potential at the connection point B is Vs. The switching TFT 712 is provided between the gate terminal of the driving TFT 710 and a power supply wiring line Vr, the switching TFT 713 is provided between a source terminal of the driving TFT 710 and the connection point A, and the capacitor 722 is provided between the connection point A and the power supply wiring line Vr.

A gate terminal of the switching TFT 711 is connected to a scanning line Gi, gate terminals of the respective switching TFTs 712 and 713 are connected to a control line Wi, and a gate terminal of the switching TFT 714 is connected to a control line Ri.

As with the pixel circuit 100, the pixel circuit 700 operates according to the timing chart shown in FIG. 3. With reference to FIG. 3, the operation of the pixel circuit 700 will be described bellow. Before time t0, the potentials of the scanning line Gi and the control line Wi are controlled to GL and the potential of the control line Ri is controlled to GH. Thus, the switching TFT 714 is in a conduction state and the switching TFTs 711 to 713 are in a non-conduction state. At this time, since the driving TFT 710 is in a conduction state, a current flows through the organic EL element 730 from the power supply wiring line Vp through the driving TFT 710 and the switching TFT 714 and thus the organic EL element 730 emits light.

When at time t0 the potential of the control line Wi is changed to GH, the switching TFTs 712 and 713 are changed to a conduction state. Thus, the gate terminal of the driving TFT 710 is connected to the power supply wiring line Vr through the switching TFT 712, and thus, the gate terminal potential of the driving TFT 710 is changed to Vref. Also, the source terminal of the driving TFT 710 and the connection point A are equal in potential.

Then, when at time t1 the potential of the control line Ri is changed to GL, the switching TFT 714 is changed to a non-conduction state. Thus, the current flowing through the organic EL element 730 from the power supply wiring line Vp is interrupted. Instead of this, a current flows into the connection point A from the power supply wiring line Vp through the driving TFT 710 and the switching TFT 713, and the potential at the connection point A (which is equal to the source terminal potential of the driving TFT 710) rises while the driving TFT 710 is in a conduction state. Accordingly, the gate-source voltage of the driving TFT 710 drops and when this voltage becomes a threshold voltage Vth (positive value) (i.e., the source terminal potential becomes (Vref−Vth)), the driving TFT 710 is changed to a non-conduction state. Hence, the potential at the connection point A rises to (Vref−Vth).

Then, when at time t2 the potential of the control line Wi is changed to GL, the switching TFTs 712 and 713 are changed to a non-conduction state. At this time, a potential difference Vth between the gate terminal of the driving TFT 710 and the connection point A is held in the capacitor 721.

Then, when at time t3 the potential of the scanning line Gi is changed to GH, the switching TFT 711 is changed to a conduction state and the connection point A is connected to the data line Sj through the switching TFT 711. While the potential of the scanning line Gi is GH, the potential of the data line Sj is controlled to a data potential Vda. Thus, at time t3, the potential at the connection point A is changed from (Vref−Vth) to Vda, and accordingly, the gate terminal potential of the driving TFT 710 is changed by the same amount (Vda−Vref+Vth) and thus becomes (Vda+Vth).

Then, when at time t4 the potential of the scanning line Gi is changed to GL, the switching TFT 711 is changed to a non-conduction state. At this time, a potential difference (VDD−Vda) between the connection point A and the power supply wiring line Vr is held in the capacitor 722.

Then, when at time t5 the potential of the control line Ri is changed to GH, the switching TFT 714 is changed to a conduction state. Thus, a current flows through the organic EL element 730 from the power supply wiring line Vp through the driving TFT 710 and the switching TFT 714. Although the amount of current flowing through the driving TFT 710 increases or decreases depending on the gate terminal potential (Vda+Vth), even when the threshold voltage Vth is different, if the data potential Vda is the same, then the amount of current is the same. Therefore, regardless of the value of the threshold voltage Vth of the driving TFT 710, a current of an amount according to the data potential Vda flows through the organic EL element 730 and thus the organic EL element 730 emits light with a specified luminance. Note that since the driving TFT 710 is of an n-channel type, if Vda≧Vref is satisfied, then the higher the potential Vda the larger the amount of current flowing through the driving TFT 710 and thus the organic EL element 730 emits light more brightly.

As described above, in the pixel circuit 700, by controlling the switching TFT 712 connected to the power supply wiring line Vr to a conduction state, the driving TFT 710 can be set to a threshold state without bringing the switching TFT 711 connected to the data line Sj into a conduction state. In addition, since a gate terminal potential of the driving TFT 710 is held by the capacitor 722 having one electrode connected to the power supply wiring line Vr, even when a power supply voltage to be supplied to the pixel circuit 700 from the power supply wiring line Vp varies between the compensation period and the light emission period, the gate terminal potential of the driving TFT 710 is not affected by this variation. Therefore, according to the display device according to the present embodiment, a period during which variations in the threshold voltage of the driving TFT are compensated for can be freely set and high-quality display can be performed by holding a gate terminal potential of the driving TFT during light emission from the organic EL element.

Eighth Embodiment

Figure 10:
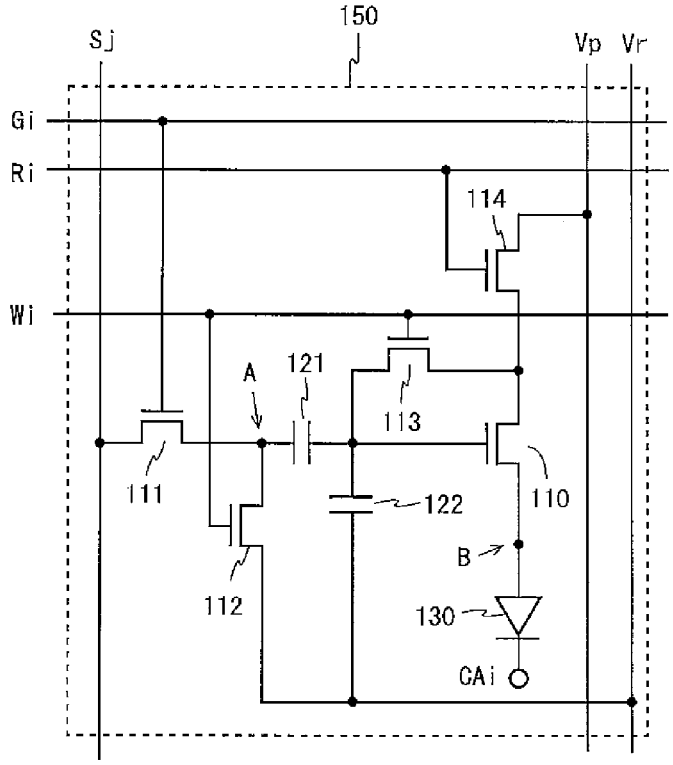
FIG. 10 is a circuit diagram of a pixel circuit included in a display device according to the eighth embodiment of the present invention.

FIG. 10 is a circuit diagram of a pixel circuit included in a display device according to the eighth embodiment of the present invention. A pixel circuit 150 shown in FIG. 10 includes a driving TFT 110, switching TFTs 111 to 114, capacitors 121 and 122, and an organic EL element 130. All of the TFTs included in the pixel circuit 150 are of an n-channel type.

The pixel circuit 150 is one obtained by making a change to the pixel circuit 100 (FIG. 2) according to the first embodiment such that a cathode terminal of the organic EL element 130 is connected to a cathode wiring line CAi. In the pixel circuit 150, on a path connecting a power supply wiring line Vp to the cathode wiring line CAi, in order from the side of the power supply wiring line Vp, the switching TFT 114, the driving TFT 110, and the organic EL element 130 are provided in series. Except for the above point, the configuration of the pixel circuit 150 is the same as that of the pixel circuit 100.

Figure 11:
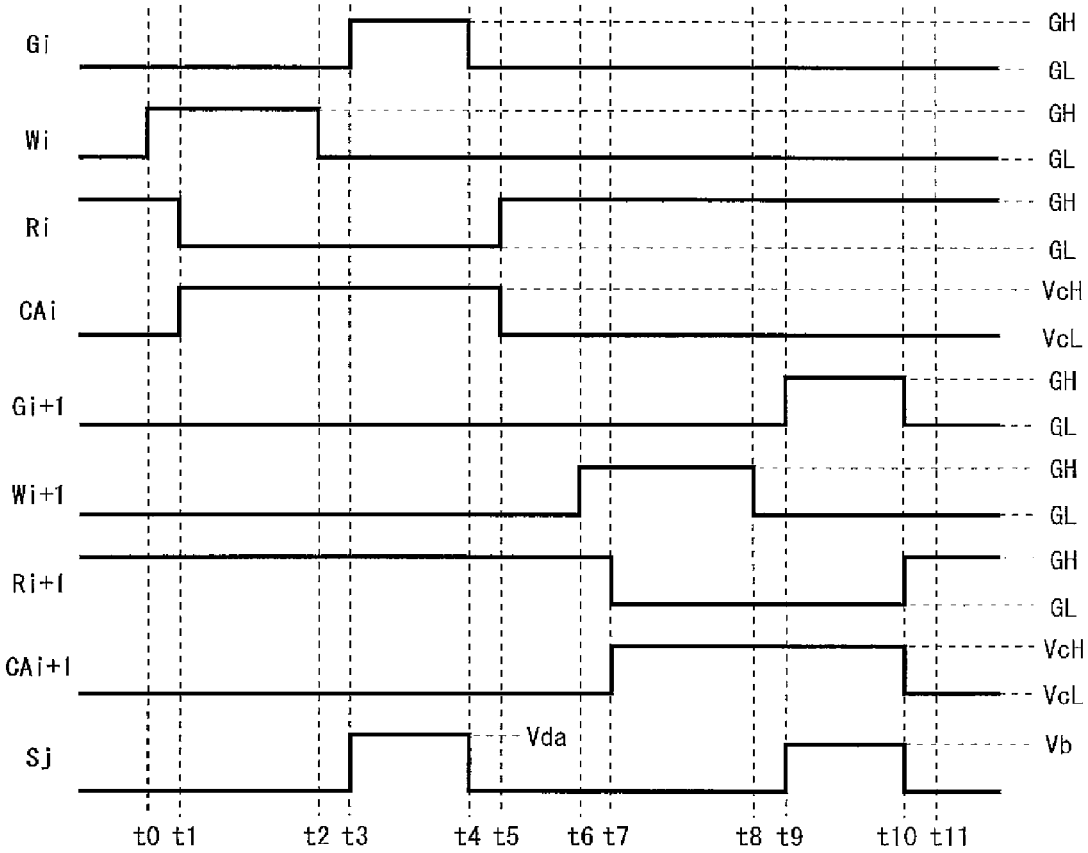
FIG. 11 is a timing chart of a pixel circuit of a display device according to the eighth and ninth embodiments of the present invention.

FIG. 11 is a timing chart of the pixel circuit 150. The timing chart shown in FIG. 11 is one such that a change in the potential of the cathode wiring line CAi is added to the timing chart shown in FIG. 3. The potential of the cathode wiring line CAi is controlled by a power supply switching circuit (not shown) included in the display device 10.

As shown in FIG. 11, the potential of the cathode wiring line CAi is controlled to VcH during the period from time t1 to time t5 and controlled to VcL during other times. The potential VcH is determined such that a voltage to be applied to the organic EL element 130 becomes a reverse bias (alternatively, the voltage becomes lower than a light-emission threshold voltage of the organic EL element 130). Hence during the period from time t1 to time t5, a current does not flow through the organic EL element 130 from the power supply wiring line Vp. As such, in the pixel circuit 150, the organic EL element 130 does not emit light upon writing. Except for the above points, the operation of the pixel circuit 150 is the same as that of the pixel circuit 100.

Thus, according to the display device according to the present embodiment, the same effects as those obtained in the first embodiment can be obtained, and unwanted light emission from the organic EL element 130 can be prevented, the contrast of a display screen can be enhanced, and the lifetime of the organic EL element 130 can be extended.

Note that it is desirable that the potential VcH be a potential close to a threshold voltage of the organic EL element 130. By using the potential VcH close to the threshold voltage of the organic EL element 130, the voltage amplitude of the cathode wiring line CAi is reduced and thus power consumption required to charge and discharge the cathode wiring line CAi can be reduced.

Ninth Embodiment

Figure 12:
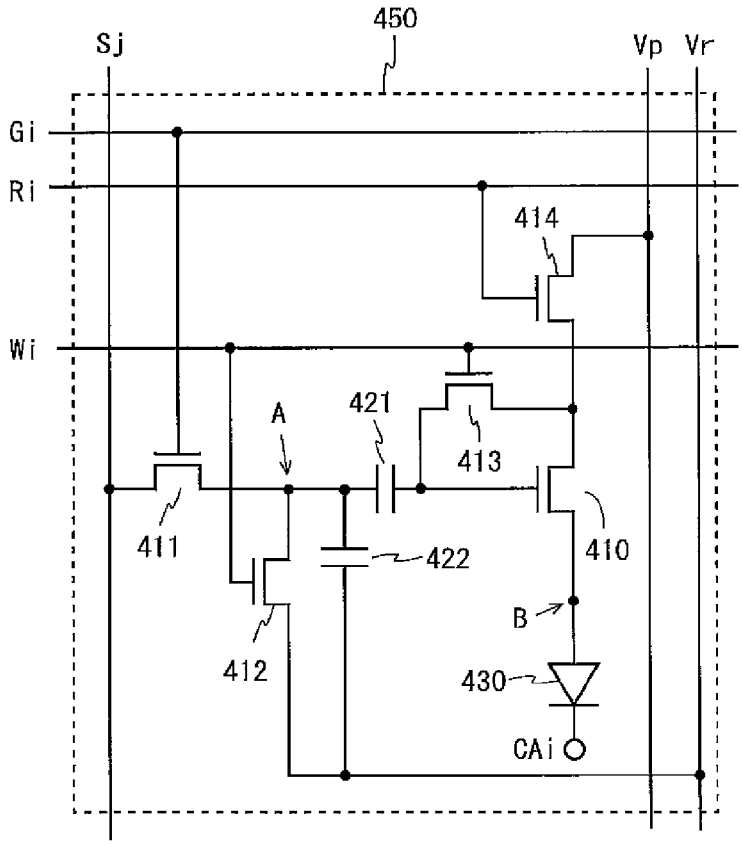
FIG. 12 is a circuit diagram of a pixel circuit included in a display device according to the ninth embodiment of the present invention.

FIG. 12 is a circuit diagram of a pixel circuit included in a display device according to the ninth embodiment of the present invention. A pixel circuit 450 shown in FIG. 12 includes a driving TFT 410, switching TFTs 411 to 414, capacitors 421 and 422, and an organic EL element 430. All of the TFTs included in the pixel circuit 450 are of an n-channel type.

The pixel circuit 450 is one obtained by making a change to the pixel circuit 400 (FIG. 6) according to the fourth embodiment such that a cathode terminal of the organic EL element 430 is connected to a cathode wiring line CAi. In the pixel circuit 450, on a path connecting a power supply wiring line Vp to the cathode wiring line CAi, in order from the side of the power supply wiring line Vp, the switching TFT 414, the driving TFT 410, and the organic EL element 430 are provided in series. Except for the above point, the configuration of the pixel circuit 450 is the same as that of the pixel circuit 400.

As with the pixel circuit 150, the pixel circuit 450 operates according to the timing chart shown in FIG. 11. In the pixel circuit 450, at time t4, a potential difference between a gate terminal of the driving TFT 410 and a power supply wiring line Vr is held in a circuit made by connecting the capacitors 421 and 422 in series. Except for the above point, the operation of the pixel circuit 450 is the same as that of the pixel circuit 150.

Thus, according to the display device according to the present embodiment, the same effects as those obtained in the first embodiment can be obtained, and unwanted light emission from the organic EL element 430 can be prevented, the contrast of a display screen can be enhanced, and the lifetime of the organic EL element 430 can be extended.

Tenth Embodiment

Figure 13:
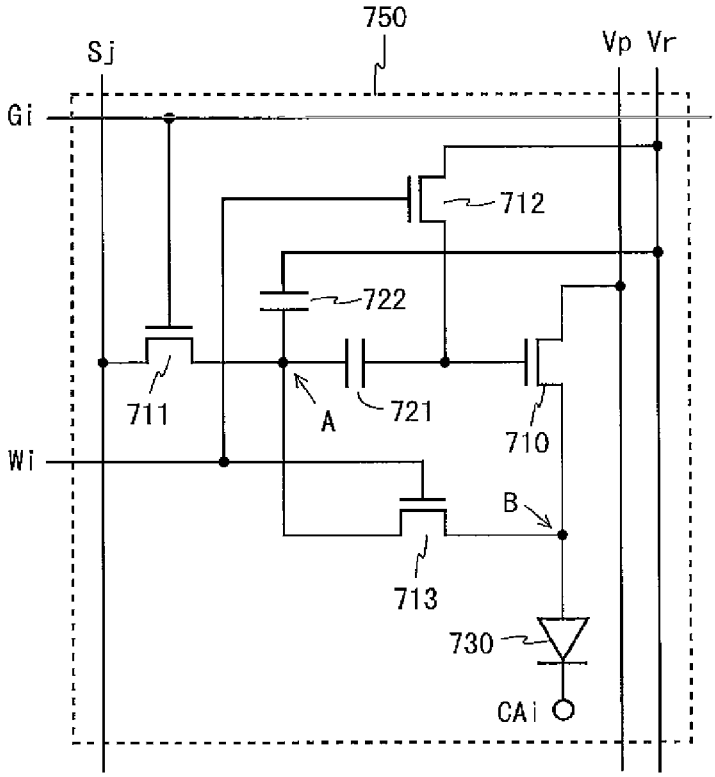
FIG. 13 is a circuit diagram of a pixel circuit included in a display device according to the tenth embodiment of the present invention.

FIG. 13 is a circuit diagram of a pixel circuit included in a display device according to the tenth embodiment of the present invention. A pixel circuit 750 shown in FIG. 13 includes a driving TFT 710, switching TFTs 711 to 713, capacitors 721 and 722, and an organic EL element 730. All of the TFTs included in the pixel circuit 750 are of an n-channel type.

The pixel circuit 750 is one obtained by making a change to the pixel circuit 700 (FIG. 9) according to the seventh embodiment such that the switching TFT 714 is eliminated and a cathode terminal of the organic EL element 730 is connected to a cathode wiring line CAi. In the pixel circuit 750, on a path connecting a power supply wiring line Vp to the cathode wiring line CAi, in order from the side of the power supply wiring line Vp, the driving TFT 710 and the organic EL element 730 are provided in series.

Figure 14:
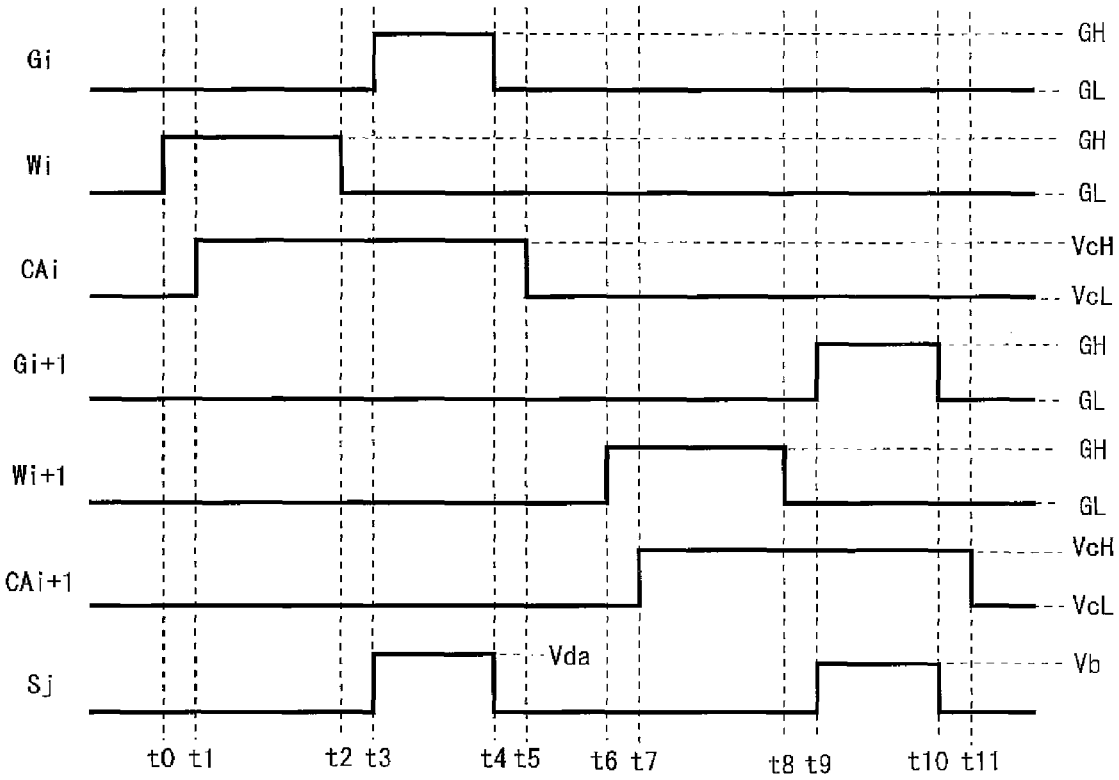
FIG. 14 is a timing chart of a pixel circuit according to the tenth embodiment of the present invention.
Figure 15:
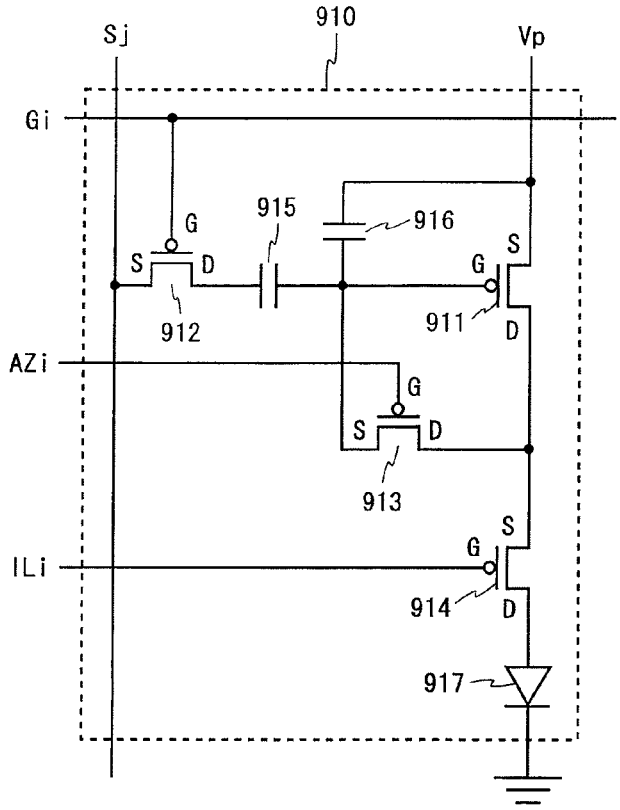
Fig. 15 Prior Art
FIG. 15 is a circuit diagram of a pixel circuit (first example) included in a conventional display device.
Figure 16:
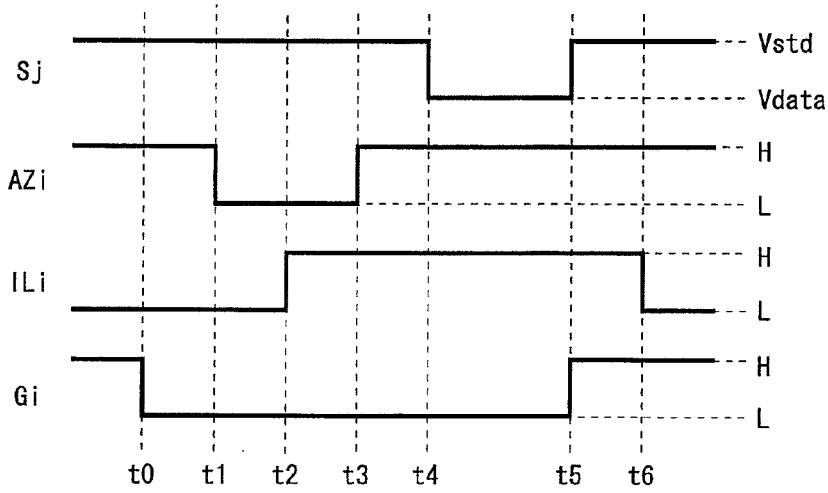
Fig. 16 Prior Art
FIG. 16 is a timing chart of the pixel circuit shown in FIG. 15.
Figure 17:
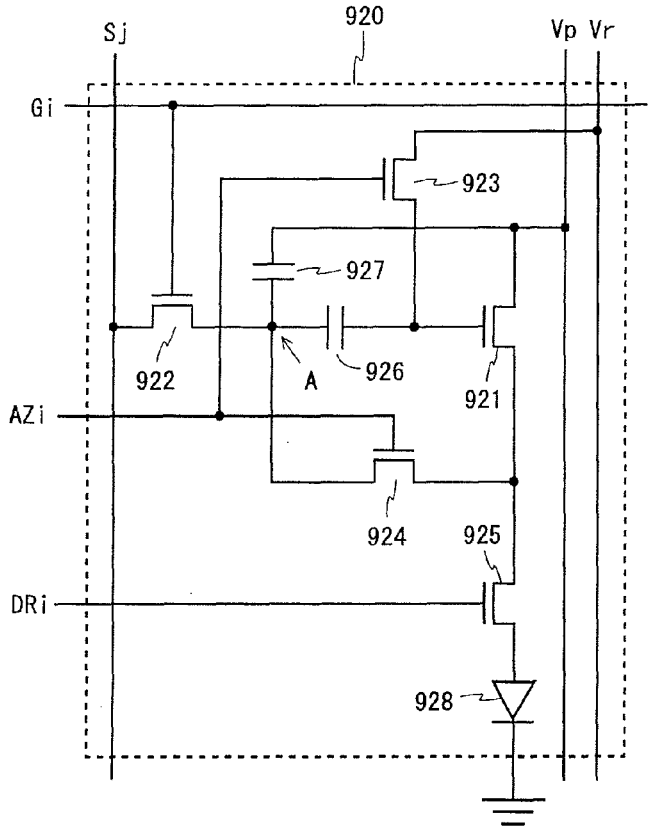
Fig. 17 Prior Art
FIG. 17 is a circuit diagram of a pixel circuit (second example) included in a conventional display device.
Figure 18:
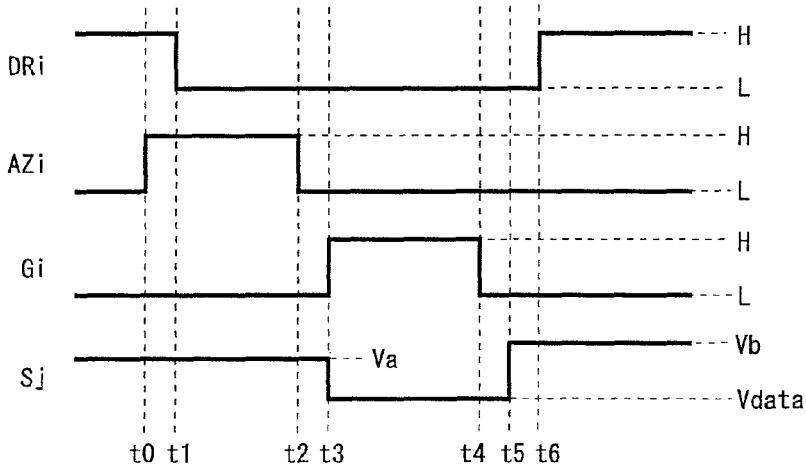
Fig. 18 Prior Art
FIG. 18 is a timing chart of the pixel circuit shown in FIG. 17.
Figure 19:
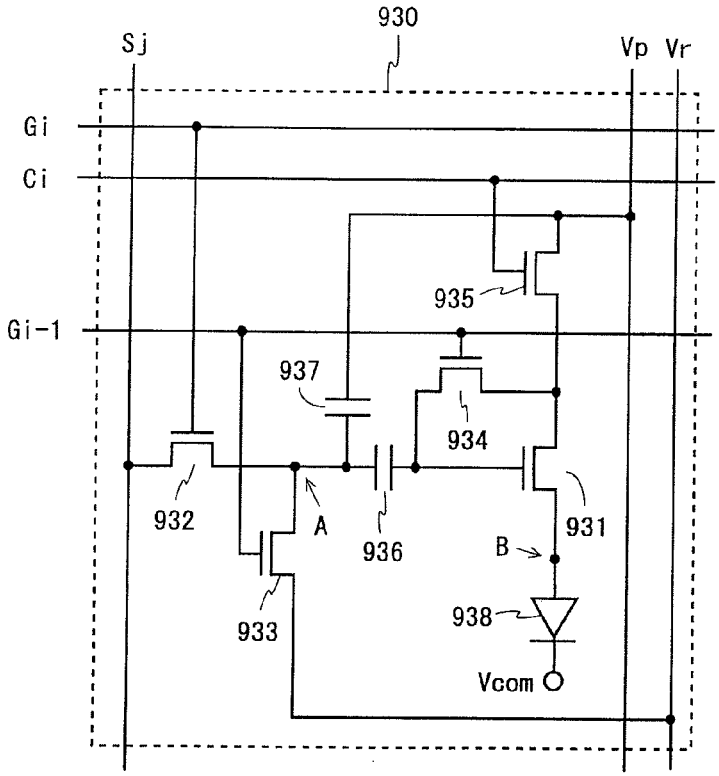
Fig. 19 Prior Art
FIG. 19 is a circuit diagram of a pixel circuit (third example) included in a conventional display device.
Figure 20:
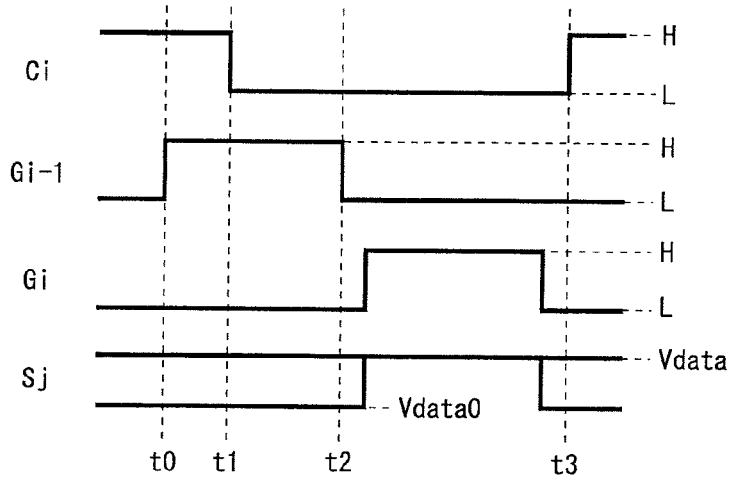
Fig. 20 Prior Art
FIG. 20 is a timing chart of the pixel circuit shown in FIG. 19.
Figure 21:
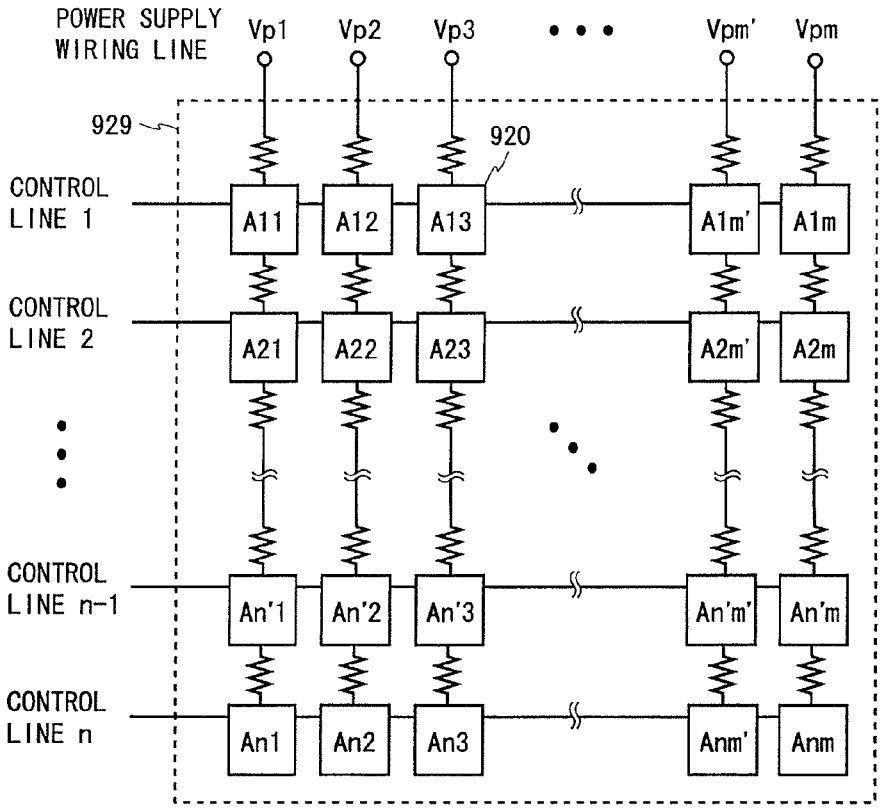
Fig. 21 Prior Art
FIG. 21 is a diagram showing a pixel array including a plurality of pixel circuits shown in FIG. 19.
Figure 22A:
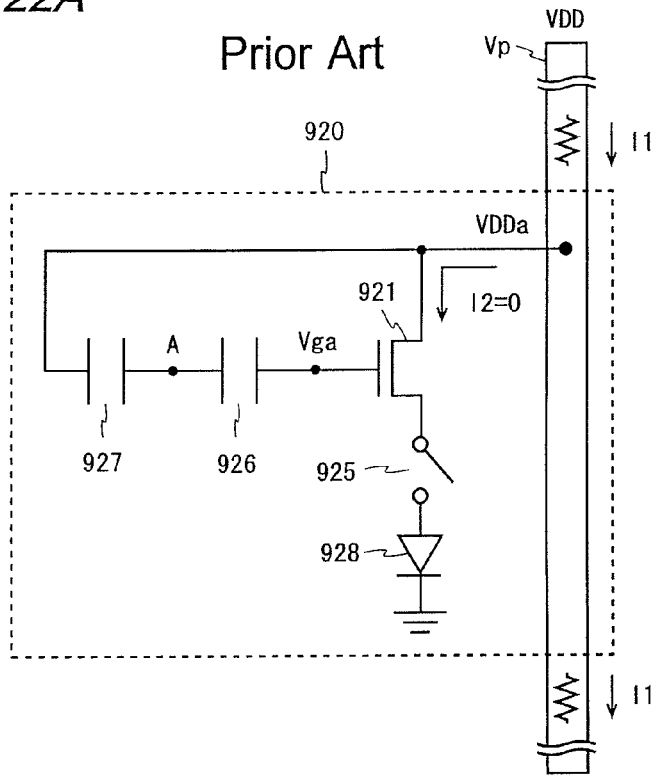
FIG. 22A is a diagram showing an equivalent circuit of the pixel circuit shown in FIG. 19 for a compensation period.
Figure 22B:
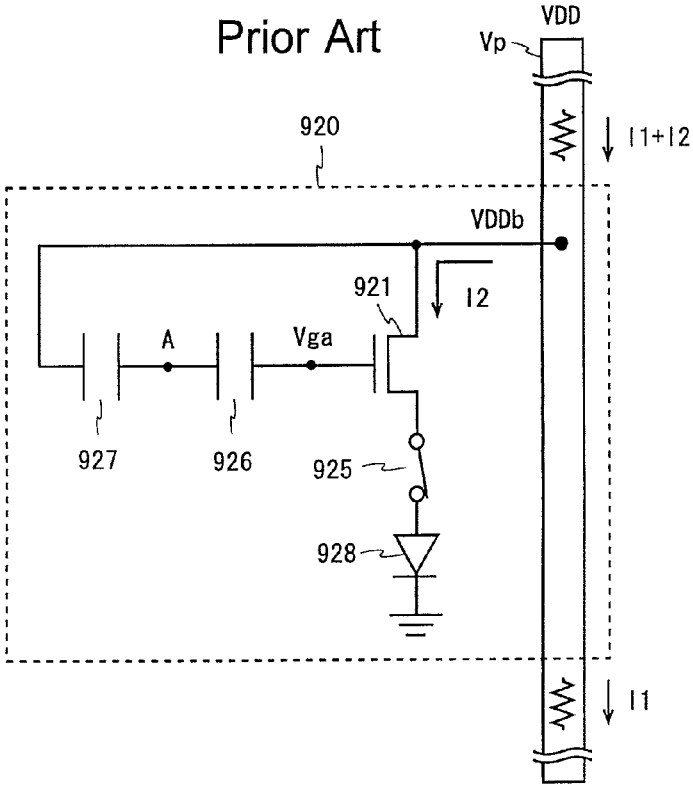
FIG. 22B is a diagram showing an equivalent circuit of the pixel circuit shown in FIG. 19 for a light emission period.

FIG. 14 is a timing chart of the pixel circuit 750. The timing chart shown in FIG. 14 is one such that the changes in the potentials of the control lines Ri and Ri+1 (which are not used in the present embodiment) are eliminated from the timing chart shown in FIG. 11. As shown in FIG. 11, the potential of the cathode wiring line CAi is controlled to VcH during the period from time t1 to time t5 and controlled to VcL during other times. The potential VcH is determined such that a voltage to be applied to the organic EL element 730 becomes a reverse bias (alternatively, the voltage becomes lower than a light-emission threshold voltage of the organic EL element 730). Hence, during the period from time t1 to time t5, a current does not flow through the organic EL element 730 from the power supply wiring line Vp.

The pixel circuit 750 operates in substantially the same manner as the pixel circuit 700. Note, however, that in the pixel circuit 700 the potential of the control line Ri is controlled to GL during the period from time t1 to time t5, whereby the switching TFT 714 goes into a non-conduction state and thus a current flowing through the organic EL element 730 from the power supply wiring line Vp is interrupted. In contrast, in the pixel circuit 750, the potential of the cathode wiring line CAi is controlled to VcH during the period from time t1 to time t5, whereby a current flowing through the organic EL element 730 from the power supply wiring line Vp is interrupted. Except for the above points, the operation of the pixel circuit 750 is the same as that of the pixel circuit 700.

Thus, according to the display device according to the present embodiment, the same effects as those obtained in the first embodiment can be obtained, and unwanted light emission from the organic EL element 730 can be prevented, the contrast of a display screen can be enhanced, and the lifetime of the organic EL element 730 can be extended.

As described above, according to the display devices according to the embodiments, a period during which variations in the threshold voltage of the driving TFT are compensated for can be freely set and high-quality display can be performed by holding a gate terminal potential of the driving TFT during light emission from the organic EL element. In addition, unwanted light emission from the organic EL element can be prevented, the contrast of a display screen can be enhanced, and the lifetime of the organic EL element can be extended. The present invention is not limited to the embodiments and the features of the embodiments can be appropriately combined.

Note that although in the above description a pixel circuit includes an organic EL element as an electro-optical element, the pixel circuit may include, as an electro-optical element, an electric current driving type electro-optical element other than an organic EL element, such as a semiconductor LED (Light Emitting Diode) or a light-emitting portion of an FED.

In the above description, the pixel circuit includes, as a drive element for the electro-optical element, a TFT which is a MOS transistor (here, the MOS transistor includes a silicon gate MOS structure) formed on an insulating substrate such as a glass substrate. The configuration is not limited thereto and the pixel circuit may include, as a drive element for the electro-optical element, any voltage control type element in which the output current changes according to a control voltage to be applied to a current control terminal and which has a control voltage (threshold voltage) by which the output current becomes zero. Thus, for a drive element for the electro-optical element, for example, a common insulated-gate type field-effect transistor including a MOS transistor, etc., formed on a semiconductor substrate can be used. By using an insulated-gate type field-effect transistor as a drive element, a current flowing through the drive element can be prevented from flowing through the electro-optical element when compensating for variations in the threshold voltage of the drive element. Thus, unwanted light emission from the electro-optical element can be prevented, the contrast of a display screen can be enhanced, and deterioration of the electro-optical element can be suppressed.

Although in the above description an n-channel type transistor is used as a switching element, a p-channel type transistor may be used as a switching element. When a p-channel type transistor is used, comparing with the case of using an n-channel type transistor, there is a need to invert the polarity of a control signal to be supplied to a gate terminal. The absolute value of a voltage to be applied to the gate terminal when using a p-channel type transistor may be different from that for the case of using an n-channel type transistor.

Although in the above description the pixel circuit includes TFTs as switching elements, the pixel circuit may include, as switching elements, common insulated-gate type field-effect transistors including MOS transistors, etc., formed on a semiconductor substrate.

The present invention is not limited to the above-described embodiments and various changes can be made. Embodiments obtained by appropriately combining technical means respectively disclosed in the different embodiments are also included in the technical scope of the present invention.

INDUSTRIAL APPLICABILITY

A display device of the present invention obtains the effects of being able to freely set a period during which variations in the threshold voltage of a drive element are compensated for and to perform high-quality display by holding a control terminal potential of the drive element during light emission from an electro-optical element, and thus, can be used for various display devices including electric current driving type display elements, such as an organic EL display and an FED.

The invention claimed is:

1. An electric current driving type display device comprising:

a plurality of pixel circuits arranged so as to correspond to respective intersections of a plurality of scanning lines and a plurality of data lines;

a scanning signal output circuit that selects a write-target pixel circuit using the scanning line; and a display signal output circuit that provides potentials according to display data to the data lines, wherein each of the pixel circuits includes:

an electro-optical element provided between a first power supply wiring line and a second power supply wiring line;

a drive element provided in series with the electro-optical element and between the first power supply wiring line and the second power supply wiring line;

a first capacitor having a first electrode connected to a control terminal of the drive element;

a first switching element provided between a second electrode of the first capacitor and the data line;

a second switching element provided between the second electrode of the first capacitor and a third power supply wiring line;

a third switching element provided between the control terminal of the drive element and one current input/output terminal of the drive element;

a fourth switching element provided between the first power supply wiring line and the drive element; and a second capacitor having one electrode connected to the third power supply wiring line and having an other electrode connected to any one of the electrodes of the first capacitor.

2. The display device according to claim 1, wherein the pixel circuit further includes a fifth switching element provided between a connection point between the drive element and the electro-optical element, and the third power supply wiring line.

3. The display device according to claim 1, wherein the pixel circuit further includes a fifth switching element provided between a connection point between the drive element and the electro-optical element, and the second power supply wiring line.

4. The display device according to claim 1, wherein when writing to the pixel circuit, a potential of the second power supply wiring line is controlled such that an applied voltage to the electro-optical element is lower than a light-emission threshold voltage.

5. The display device according to claim 1, wherein the electro-optical element includes an organic EL element.

6. The display device according to claim 1, wherein the drive element and all of the switching elements in the pixel circuit include insulated-gate type field-effect transistors.

7. The display device according to claim 1, wherein the drive element and all of the switching elements in the pixel circuit include thin-film transistors.

8. The display device according to claim 7, wherein the thin-film transistors include amorphous silicon.

9. The display device according to claim 1, wherein all of the switching elements in the pixel circuit include n-channel type transistors.

10. A pixel circuit, a plurality of which are arranged in an electric current driving type display device so as to correspond to respective intersections of a plurality of scanning lines and a plurality of data lines, the pixel circuit comprising;

an electro-optical element provided between a first power supply wiring line and a second power supply wiring line;

a drive element provided in series with the electro-optical element and between the first power supply wiring line and the second power supply wiring line;

a first capacitor having a first electrode connected to a control terminal of the drive element;

a first switching element provided between a second electrode of the first capacitor and the data line;

a second switching element provided between the second electrode of the first capacitor and a third power supply wiring line;

a third switching element provided between the control terminal and one current input/output terminal of the drive element;

a fourth switching element provided between the first power supply wiring line and the drive element; and a second capacitor having one electrode connected to the third power supply wiring line and having an other electrode connected to any one of the electrodes of the first capacitor.

* * * * *